US007095964B2

(12) United States Patent
Koyama et al.

(10) Patent No.: US 7,095,964 B2
(45) Date of Patent: Aug. 22, 2006

(54) IMAGE FORMING APPARATUS DETERMINING AN INDICATING LEVEL OF A UTILIZED AMOUNT OF A DEVELOPING APPARATUS AND A CONTROL METHOD THEREOF

(75) Inventors: Shoichi Koyama, Shizuoka (JP); Koichi Suzuki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 108 days.

(21) Appl. No.: 10/664,888

(22) Filed: Sep. 22, 2003

(65) Prior Publication Data

US 2004/0114946 A1 Jun. 17, 2004

(30) Foreign Application Priority Data

Sep. 24, 2002 (JP) ..... 2002-277213
Sep. 19, 2003 (JP) ..... 2003-328061

(51) Int. Cl.
*G03G 15/00* (2006.01)

(52) U.S. Cl. ..... 399/24; 399/27; 399/64

(58) Field of Classification Search ..... None
See application file for complete search history.

(56) References Cited

U.S. PATENT DOCUMENTS 5,124,751 A * 6/1992 Fukui et al. ..... 399/44
5,365,319 A * 11/1994 Sakemi et al. ..... 399/44
5,581,221 A * 12/1996 Kawai et al. ..... 399/49
5,649,264 A 7/1997 Domon et al. ..... 399/30
6,208,816 B1 * 3/2001 Koizumi et al. ..... 399/27
6,397,017 B1 * 5/2002 Sakai et al. ..... 399/27
6,397,018 B1 * 5/2002 Matsumoto et al. ..... 399/27
6,415,112 B1 7/2002 Kimizuka et al. ..... 399/27
6,516,159 B1 * 2/2003 Sakurai ..... 399/27
6,535,699 B1 * 3/2003 Abe et al. ..... 399/27
6,615,001 B1 * 9/2003 Otomo et al. ..... 399/27
2002/0057918 A1 5/2002 Kojima et al. ..... 399/27

(Continued)

FOREIGN PATENT DOCUMENTS

JP 5-6092 1/1993

(Continued)

OTHER PUBLICATIONS

Patent Abstracts of Japan, Kokai No. 2001-318566, Nov. 16, 2001.

(Continued)

*Primary Examiner*—Robert Beatty
(74) *Attorney, Agent, or Firm*—Fitzpatrick, Cella, Harper & Scinto

(57) ABSTRACT

The image forming apparatus, to which a developing apparatus for developing a latent image on an image bearing member corresponding to image information is detachably attachable, includes, a first detection device for detecting an amount of developer in the developing apparatus; a second detection device for detecting a utilized amount of the developer in the developing apparatus based upon the image information, and a processing unit for judging a utilized amount level of the developing apparatus based upon results of detection of the first detection device and the second detection device, wherein the processing unit judges the utilized amount level of the developing apparatus using the result of detection of the first detection device and the result of detection of the second detection device until the result of detection of the first detection device reaches a predetermined value, and judges the utilized amount level of the developing apparatus using the result of detection of the first detection device after the result of detection of the first detection device has reached the predetermined value. Consequently, it becomes possible to detect the residual amount of developer with high accuracy.

11 Claims, 15 Drawing Sheets

U.S. PATENT DOCUMENTS

2002/0061196 A1 5/2002 Miyamoto et al. ..... 399/27

FOREIGN PATENT DOCUMENTS

| | | |
|---|---|---|
| JP | 7-140776 | 6/1995 |
| JP | 10-239980 | 9/1998 |
| JP | 2000-181214 | 6/2000 |
| JP | 2001-228698 | 8/2001 |
| JP | 2001-318566 | 11/2001 |

OTHER PUBLICATIONS

Patent Abstracts of Japan, Kokai No. 2001-228698, Aug. 24, 2001.

* cited by examiner

| RESIDUAL AMOUNT LEVEL | OPTICAL DETECTION METHOD OF DEVELOPER AMOUNT | PRESUMPTION DETECTION METHOD OF DEVELOPER AMOUNT |
|---|---|---|
| A | KEEP LEVEL B BECAUSE OF RESIDUAL AMOUNT DETECTION INABILITY | 100% |
| B | | 80% |
| C | | 60% |
| D | | 40% |
| E | 30% | 30% |
| | 25% | |
| F | 20% | 20% |
| | 15% | |
| G | 10% | 10% |
| | 5% | |
| H | 0% | 0% |

| RESIDUAL AMOUNT LEVEL | OPTICAL DETECTION METHOD OF DEVELOPER AMOUNT | PRESUMPTION DETECTION METHOD OF DEVELOPER AMOUNT |
|---|---|---|
| A | M=B | 100% |
| B | | 80% |
| C | | 60% |
| D | 40% | 40% |
| E | 30% | N=D |
| | 25% | |
| F | 20% | |
| | 15% | |
| G | 10% | |
| | 5% | |
| H | 0% | |

| RESIDUAL AMOUNT LEVEL | OPTICAL DETECTION METHOD OF DEVELOPER AMOUNT | UTILIZED AMOUNT DETECTING METHOD OF DEVELOPER BEARING BODY |
|---|---|---|
| A | | 100% |
| B | KEEP LEVEL B BECAUSE OF RESIDUAL AMOUNT DETECTION INABILITY | 80% |
| C | | 60% |
| D | | 40% |
| E | 30% | 30% |
| | 25% | |
| F | 20% | 20% |
| | 15% | |
| G | 10% | 10% |
| | 5% | |
| H | 0% | 0% |

| RESIDUAL AMOUNT LEVEL | OPTICAL DETECTION METHOD OF DEVELOPER AMOUNT | UTILIZED AMOUNT DETECTING METHOD OF DEVELOPER BEARING BODY |
|---|---|---|
| A | M=B | 100% |
| B | | 80% |
| C | | 60% |
| D | 40% | 40% |
| E | 30% | N=D |
| | 25% | |
| F | 20% | |
| | 15% | |
| G | 10% | |
| | 5% | |
| H | 0% | |

IMAGE FORMING APPARATUS DETERMINING AN INDICATING LEVEL OF A UTILIZED AMOUNT OF A DEVELOPING APPARATUS AND A CONTROL METHOD THEREOF

BACKGROUND OF THE INVENTION

1. Field of the Invention

The present invention relates to an image forming apparatus for forming an image according to image information sent from an external apparatus such as a printer, and in particular to an image forming apparatus which is required to inform a user of replacement or supply of a consumable (developer) under a network environment, a control method for the image forming apparatus, a developing apparatus for the image forming apparatus, and a memory medium mounted on the developing apparatus.

2. Related Background Art

A method of forming a color image in an image forming apparatus as shown in FIG. 15 will be described. First, latent images, which are formed on a photosensitive drum 2 according to image information sent for each color in an optical unit 9, are developed and visualized with developers held in respective color developing apparatuses 151Y, 151M, 151C and 151K provided in a developing apparatus selection mechanism part 150. The visualized images are transferred onto an endless image bearing member 5 a plurality of times, and a multi-color image is formed on the endless image bearing member 5. Thereafter, a transfer material P selected in and fed from transfer material holding members (hereinafter referred to as sheet feed trays) 12 to 16 is conveyed to the part between the endless image bearing member 5 and a transfer/conveyor belt 6, and the multi-color image on the endless image bearing member 5 is transferred onto the transfer material P. The multi-color image transferred onto the transfer material P is thermally fixed on the transfer material P by a fixing unit 7. Thereafter, the transfer material P is conveyed and discharged to an upper tray part 19 or a lower sheet discharge tray part 20. Note that, in the case of monochrome image formation, an image developer of a single color is used to form a multiple image.

Next, a method of detecting a residual amount of developer will be described in detail.

There have been disclosed several methods of detecting a residual amount of developer to the present.

For example, there are known a method of detecting an electrostatic capacitance held by a developer in a developing apparatus to use the electrostatic capacitance for detection of a residual amount, which has already been generally used (e.g., Japanese Patent Application Laid-Open No. 5-6092), a method of detecting reflected light or transmitted light using an LED of infrared ray and an optical sensor for photoreception to use the reflected light or the transmitted light for detection of a residual amount of developer according to intensity of the detected photoreceptive intensity (e.g., Japanese Patent Application Laid-Open No. 7-140776), and a method of presuming a consumption amount of developer based upon image information at the time of image formation to use the consumption amount for detection of a residual amount (e.g., Japanese Patent Application Laid-Open No. 2001-318566).

In addition, a method of detecting a residual amount of developer using an optical system requires an optical path without a developer, through which light passes, in order to detect a residual amount of developer. That is, since light is not transmitted until the developer is used and the residual amount of developer reaches a level of a certain degree, it is difficult to detect a change in the residual amount. Thus, it is extremely difficult to sequentially detect a change in the residual amount of developer from the time when the developer is filled to a maximum degree until the time when the developer is fully consumed. In addition, contrary to the above-described method, a method of detecting a residual amount of developer of an antenna system for detecting an electrostatic capacitance in a developing apparatus can measure, with extremely high accuracy, an amount of electrostatic change from the time when a developer is filled to a maximum degree until the time when the developer has been reduced to a fixed amount. However, if the developer has been reduced to less than the fixed amount, an electrostatic capacitance is reduced to an extremely small amount. Thus, it is difficult to sequentially detect a change in the electrostatic capacitance at the time when the residual amount of developer is small. There has also been proposed to use both the above-described methods to compensate for the respective disadvantages (e.g., Japanese Patent Application Laid-Open No. 2001-228698). However, for example, in an image forming apparatus having a developing apparatus holding member of a portable type rather than a fixed developing apparatus, since an electrostatic capacitance in the developing apparatus changes largely in accordance with movement of the developing apparatus, the above-described effect cannot be obtained sufficiently in some cases.

However, with the method of presuming a consumption amount of developer based upon image information at the time of image formation to use the consumption amount for detection of residual amount, it is difficult to perform optimum presumption of a consumption amount of developer in the case in which consumption efficiency of the developer is different largely between an initial state of an image forming unit and a state after endurance due to image formation of the image forming unit.

In addition, in the developing apparatus, consumption efficiency of a developer, deterioration of electric characteristics of the developer in the developing apparatus, and abrasion of a developer regulating member or the like are different between the initial state of the image forming unit and the state after endurance due to image formation of the image forming unit. Thus, it is likely that deterioration of quality of an image, a trouble such as leakage of the developer, or the like is caused. Therefore, in order to prevent the above-described troubles from occurring, in a multi-color image forming apparatus, it is becoming necessary to detect a life of a developing apparatus taking into account not only a residual amount of developer but also deterioration of the developer and deterioration of a developer carrying member.

SUMMARY OF THE INVENTION

The present invention has been devised in view of the above-described points, and it is an object of the present invention to provide an image forming apparatus which is capable of detecting a residual amount of developer with high accuracy, a control method for the image forming apparatus, a developing apparatus for the image forming apparatus, and a memory medium mounted on the developing apparatus.

In addition, it is another object of the present invention to provide an image forming apparatus which is capable of detecting a utilized amount of a developing apparatus from the start of use, a control method for the image forming apparatus, a developing apparatus for the image forming apparatus, and a memory medium mounted on the developing apparatus.

An image forming apparatus of the present invention is an image forming apparatus to which a developing apparatus for developing a latent image on an image bearing member corresponding to image information is detachably attachable, comprising:

a first detection device for presuming a remaining amount of the developer in the developing apparatus based upon the image information;

a second detection device for detecting a remaining amount of the developer in the developing apparatus; and a processing unit for determining an indicating level of the remaining amount of the developer in the developing apparatus based upon results of detections of the first detection device and the second detection device, wherein in a case that the first remaining amount of the developer presumed by said first detection device is equal to or less than an amount defined as a predetermined amount, and the second remaining amount of the developer detected by said second detection device is equal to or more a predetermined amount, the indicating level determined by said processing unit of the remaining amount of the developer in said developing apparatus is different from both an indicating level according to the first remaining amount of the developer by said first detection device and an indicating level according to the second remaining amount of the developer detected by said second detection device.

Another image forming apparatus of the present invention is an image forming apparatus to which a developing apparatus including a developer carrying (bearing) member for developing a latent image on an image bearing member is detachably attachable, comprising:

a first detection device for detecting a utilized amount of said developer of the developing apparatus;

a second detection device for detecting a remaining amount of developer in said developing apparatus; and a processing unit for determining an indicating level of a utilized amount of the developing apparatus based upon results of detection of the first detection device and the second detection device, wherein in a case that the utilized amount of said developer carrying member detected by said first detection device is equal to or less than a predetermined amount, and the remaining amount of the developer detected by said second detection device is equal to or more a predetermined level, the indicating level of a utilized amount of said developing apparatus determined by said processing unit is different from both an indicating level of a utilized amount of said developing apparatus according to the utilized amount of said developer carrying member detected by said first detection device and an indicating level of a utilized amount of said developing apparatus according to the remaining amount of the developer detected by said second detection device.

A control method for an image forming apparatus to which a developing apparatus for developing a latent image on an image bearing member corresponding to image information is detachably attachable and which comprises a first detection device for presuming a remaining amount of developer in the developing apparatus based upon the image information, and a second detection device for detecting a remaining amount of developer in the developing apparatus, the control method comprising:

a first judging step of judging whether or not a first remaining amount of the developer detected by the first detection device is equal to or less than a predetermined amount; and a second judging step of judging the utilized amount level of the developing apparatus using the result whether or not a second remaining amount of the developer detected by the second detection device is equal to or more a predetermined amount;

a determining step for determining, in a case that the first remaining amount of the developer calculated in said first judging step is equal to or less than an amount defined as the predetermined amount, and the second remaining amount of the developer detected in said second judging step is equal to or more than the predetermined level an indicating level of the remaining amount of the developer in the developing apparatus so that the indicating level is different from both an indicating level according to the first remaining amount of the developer detected by said first detection device and an indicating level according to the second remaining amount of the developer detected by said second detection device.

Another control method for an image forming apparatus to which a developing apparatus including a developer carrying member for developing a latent image on an image bearing member is detachably attachable and which comprises a first detection device for detecting a utilized amount of the developer carrying member of the developing apparatus and a second detection device for detecting a remaining amount of developer in the developing apparatus, the control method comprising:

a first judging step of judging whether or not a utilized amount of the developer carrying member detected by the first detection device is equal to or less than a predetermined amount;

a second judging step of judging whether or not a remaining amount of the developer detected by the second detection device is equal to or more than a predetermined amount; and a determining step of determining in a case that the utilized amount of the developer carrying member judging in the first judging device is equal to or less than the predetermined amount, and the remaining amount of the developer judged in said second judging step is equal to or more than the predetermined amount, the indicating level of a utilized amount of the developing apparatus is different from both an indicating level of a utilized amount of the developing apparatus according to the utilized amount of the developer carrying member detected by the first detection device and an indicating level of a utilized amount of the developing apparatus according to the remaining amount of the developer detected by the second detection device.

A developing apparatus of the present invention is a developing apparatus detachably attachable to an image forming apparatus, comprising:

a developer container containing a developer;

a developer carrying member for developing a latent image on an image bearing member;

a memory area storing information on an amount of developer; and a memory area storing information on a utilized amount of the developer carrying member.

A memory medium of the present invention is a memory medium which is mounted on a developing apparatus detachably attachable to an image forming apparatus, wherein the developing apparatus comprises a developer container containing a developer, and a developer carrying member for developing a latent image on an image bearing member, and the memory medium comprises:

a memory area storing information on an amount of developer; and a memory area storing information on a utilized amount of the developer carrying member.

Further objects of the present invention will be apparent by reading the following detailed description of the present invention with reference to the accompanying drawings.

DESCRIPTION OF THE PREFERRED EMBODIMENTS

Embodiments of an image forming apparatus, a developing apparatus, and a control method for the image forming apparatus in accordance with the present invention will be hereinafter described. However, constitutions described in the embodiments are simply examples and are not intended to limit the scope of the present invention only to them.

FIRST EMBODIMENT

Figure 2:
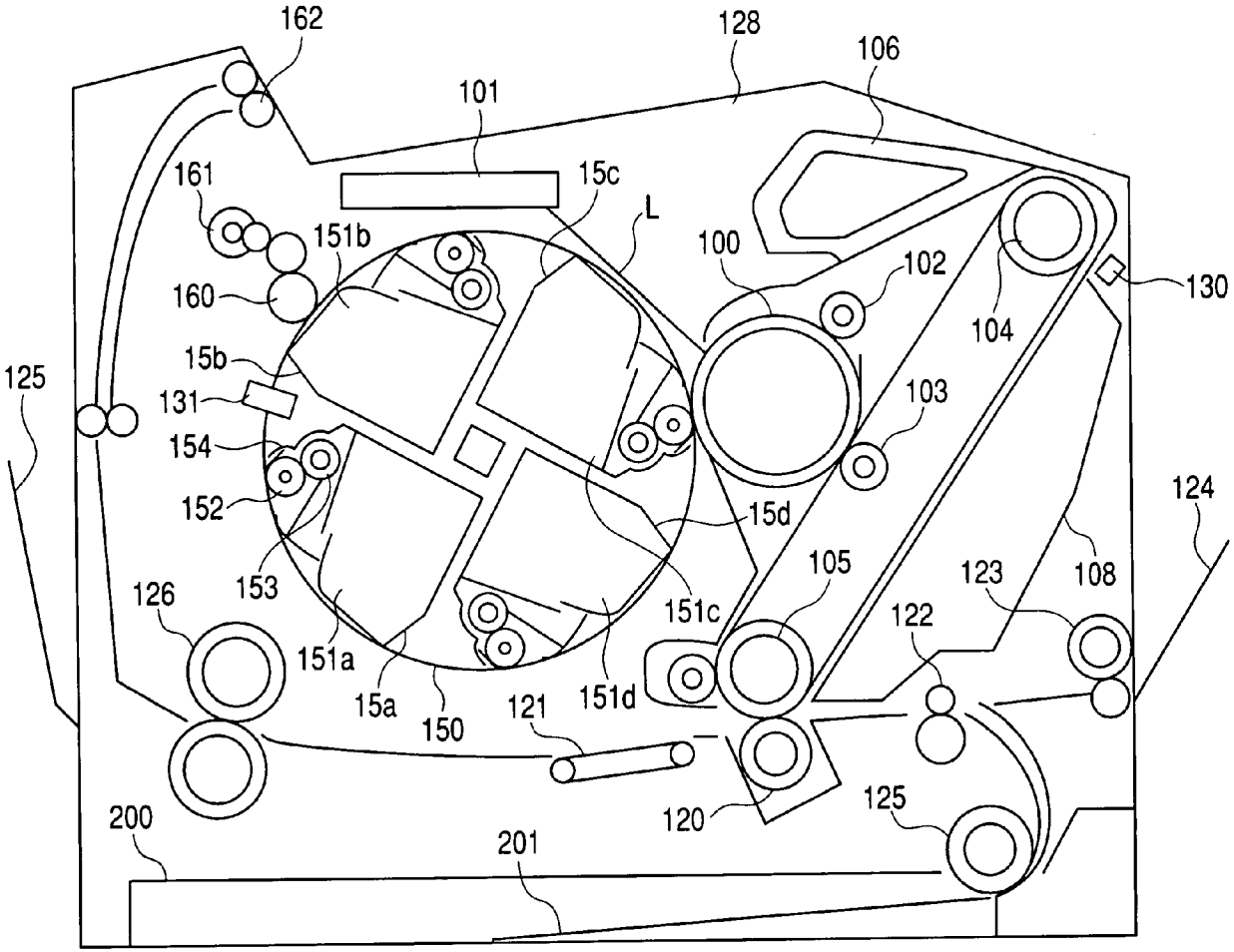
FIG. 2 is a schematic sectional view showing a schematic structure of an image forming apparatus used in the present invention.

First, FIG. 2 shows an example of a schematic structure of an image forming apparatus used in the present invention.

The image forming apparatus of this embodiment adopts a reversal development system for adhering a developer to an exposed part of an image bearing member to visualize a latent image on the image bearing member, and is a one-component image forming apparatus for bringing a developer carrying member carrying a negatively charged developer into abutment against the image bearing member to perform development. First, the image forming apparatus used in the present invention will be described with reference to FIG. 2.

The image forming apparatus includes, as main components, a photosensitive drum 100, an optical unit 101, a charging roller 102, a primary transferring roller 103, an intermediate transferring body tension roller 104, an intermediate transferring body drive roller 105, an intermediate transferring body cleaning roller 107, a rotary developing apparatus holding member 150, rotary developing apparatus holding member drive means 161, four developing apparatuses 15*a* to 15*d*, a rotary developing apparatus reference position detection sensor 131 (hereinafter referred to as home position sensor), a conveyor belt 121, a fixing unit 126, a sheet feed tray 200, a hand supply sheet feed tray 124, a density/timing sensor 130, a secondary transferring roller 120, a sheet discharge roller 162, a sheet discharge tray 125, and an upper sheet discharge tray 128.

Next, an outline of a process up to printing will be described. First, the surface of the photosensitive drum 100 is uniformly charged (e.g., −600 V) to a desired polarity by the charging roller 102 arranged on the photosensitive drum 100. Next, an electrostatic latent image is formed on the photosensitive drum 100 by exposing the photosensitive drum 100 with a laser L using the optical unit 101 based upon image data which is sent from a controller with an image synchronization signal as a reference. As an example of a process for visualizing an electrostatic latent image, an electrostatic latent image formed on the photosensitive drum 100 by an image forming unit 151*a* for yellow (Y) is developed with a developer by applying a predetermined voltage (e.g., −300 V) to a developing sleeve roller 152 to form a visualized developer image on the photosensitive drum 100.

Thereafter, the developer image on the photosensitive drum 100 is transferred onto an intermediate transferring body by the primary transferring roller 103 to hold the formed image.

Similarly, for colors of magenta (M), cyan (C) and black (Bk), latent images corresponding to respective image data are sequentially formed on the photosensitive drum 100 by developing apparatuses 151*b* to 151*d* for the respective colors and are developed with sleeves and developers of the respective developing apparatus to form developer images. The formed images are sequentially held on the intermediate transfer body.

Since the developer images of the respective colors are transferred onto the intermediate transferring body at predetermined timing, a multiple developer image is developed on the intermediate transferring body. On the other hand, after the development with a last image forming color ends, the secondary transferring roller 120 and the intermediate transferring body cleaning roller 107 are brought into abutment against the intermediate transferring body drive roller 105 at predetermined timing via the intermediate transferring body. After being brought into abutment against the intermediate transferring body, high voltages are applied to the secondary transferring roller 120 and the intermediate transferring body cleaning roller 107 (e.g., a transfer high voltage (e.g., +1000 V) of a polarity opposite to that of the developer (e.g., positive polarity) is applied to the secondary transferring roller 120, and a voltage (e.g., +1000 V and a rectangular wave voltage (e.g., 1 KHz, 2 KVpp)) of a positive polarity is applied to the intermediate transferring body cleaning roller 107 in the same manner), and for example, a voltage of the same polarity and the same potential as the first transferring roller 103 is applied to the intermediate transferring body drive roller 105 to wait for conveyance of a transfer material.

Moreover, at predetermined timing separately required for transferring the developer image, the transfer material is extracted from the sheet feed tray 200 by a sheet feed roller 125 or from the hand supply sheet feed roller 124 by a sheet feed roller 123. The extracted transfer material is once stopped by a registration roller 122 to wait for end of the image formation of the last color on the intermediate transferring body.

After the image formation of the last color ends, the registration roller 122 starts conveyance of the transfer material again at desired timing. The conveyed transfer material is conveyed to the part between the secondary transferring roller 120 and the intermediate transferring body driven by the intermediate transferring body drive roller 105, and the multi-color multiple developer image on the intermediate transferring body is transferred onto the transfer material by a potential difference between the bias applied to the intermediate transferring body drive roller 105 and the bias applied to the secondary transferring roller 120. Thereafter, the developer remaining on the intermediate transferring body after the transfer is removed or recharged by the intermediate transferring body cleaning roller 107, and is returned to the photosensitive drum 100, and collected by a blade which is in contact with the photosensitive drum 100. The residual developer collected by the blade is stored in a waste developer area 108 by a not-shown drive. In addition, the residual developer adhered to the intermediate transferring body cleaning roller 107 is collected by the photosensitive drum 100 later in a predetermined process separately.

After the transfer to the transfer material ends, the intermediate transferring body cleaning roller 107 and the secondary transferring roller 102 keep a space from the intermediate transferring body drive roller 105 and prepared for the next image formation.

Note that the surface of the cleaning photosensitive drum 100 is uniformly charged to a desired polarity again by the charging roller 102 and prepared for the next latent image formation and development process. In addition, the intermediate transferring body, from which the residual developer has been removed, is treated in the same manner.

On the other hand, the developer image transferred to the transfer material is fixed thereon from the conveyor belt 121 to the fixing roller 126. The transfer material having the developer image fixed thereon is discharged to the upper sheet discharge tray 128 or the lower sheet discharge tray 125.

In addition, the hand supply sheet feed tray 124 is opened and closed as required by a user, and the tray itself can be expanded and contracted according to a size of the transfer material. A sub-stay of the lower sheet discharge tray 125 can be expanded and contracted in the same manner. In addition, a not-shown stopper guide of the upper sheet discharge tray 128 can be expanded and contracted according to a size of the transfer material. The density/timing sensor 130 is a sensor for performing density control of the respective color developers at warm-up time in applying power supply to the color image forming apparatus or at predetermined timing. In addition, the timing is used as means which detects a reference in reading a not-shown reference position on the intermediate transferring body with reflective or transmission optical means and performing image formation. Although a density sensor and a timing sensor are described as one unit of the density/timing sensor 130 in the present invention, these may be constituted as separate units.

The above describes the outline of the printing process in the color image forming apparatus used in the present invention.

Figure 1:
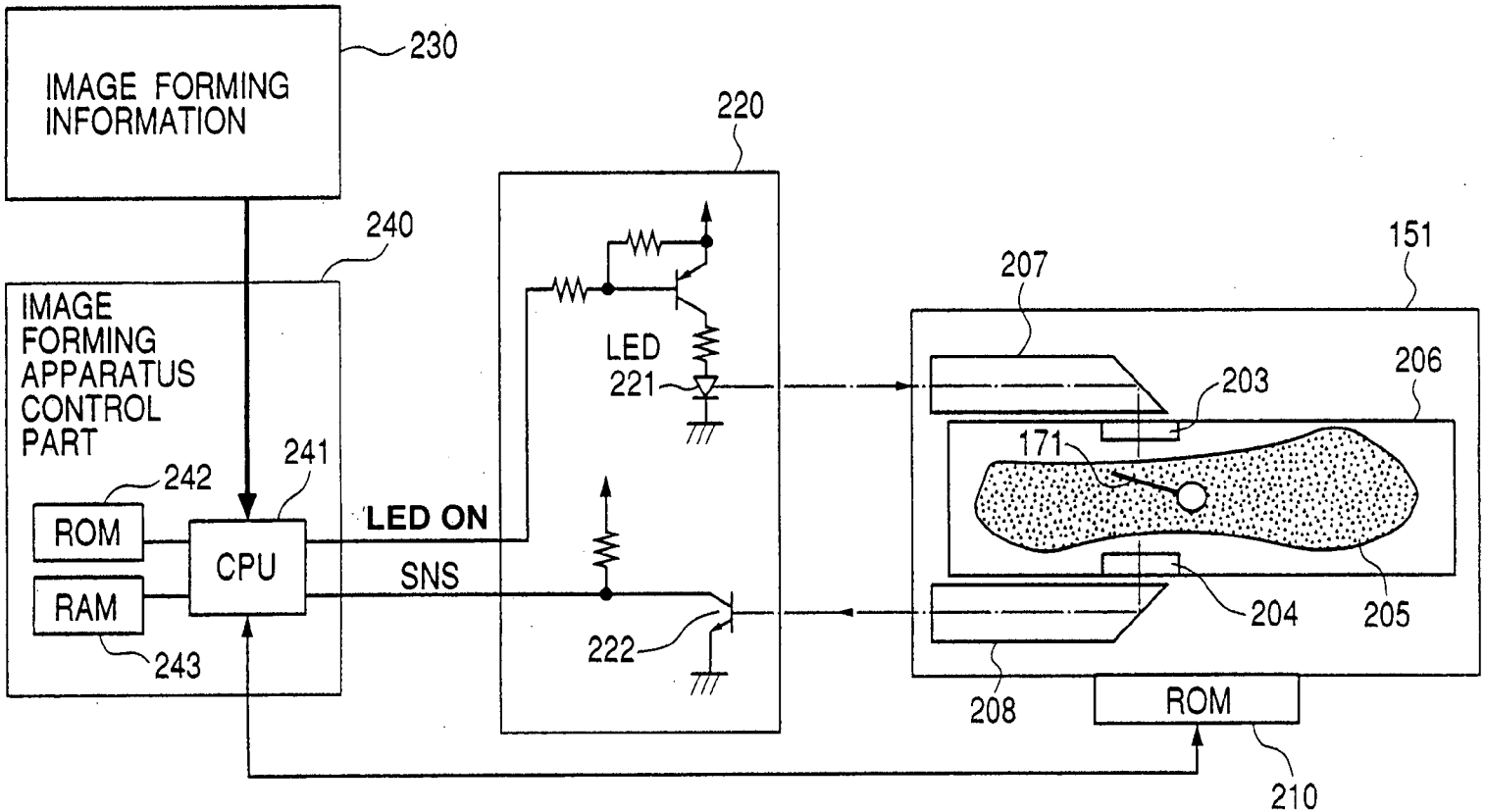
FIG. 1 is a block diagram showing an example of a structure of developer residual amount detection means in accordance with the present invention.

Next, FIG. 1 shows a block diagram which is an example of a structure of developer residual amount detection means of the embodiment in accordance with the present invention.

In FIG. 1, a residual developer amount detection device of this embodiment is adapted to be able to sequentially detect a residual amount of developer during a period in which an amount of developer in a developing apparatus changes from full to empty and detect a utilized amount level of a developing apparatus by using both of an optical developer residual amount detection system and a detection device, which presumes a consumption amount of developer by counting the number of pixels of developer image information with which a CPU 241 performs image formation using image forming information 230. Note that, in FIG. 1, one of the four developing apparatuses 15*a* to 15*d* in FIG. 2 is shown for convenient reference.

Figure 3:
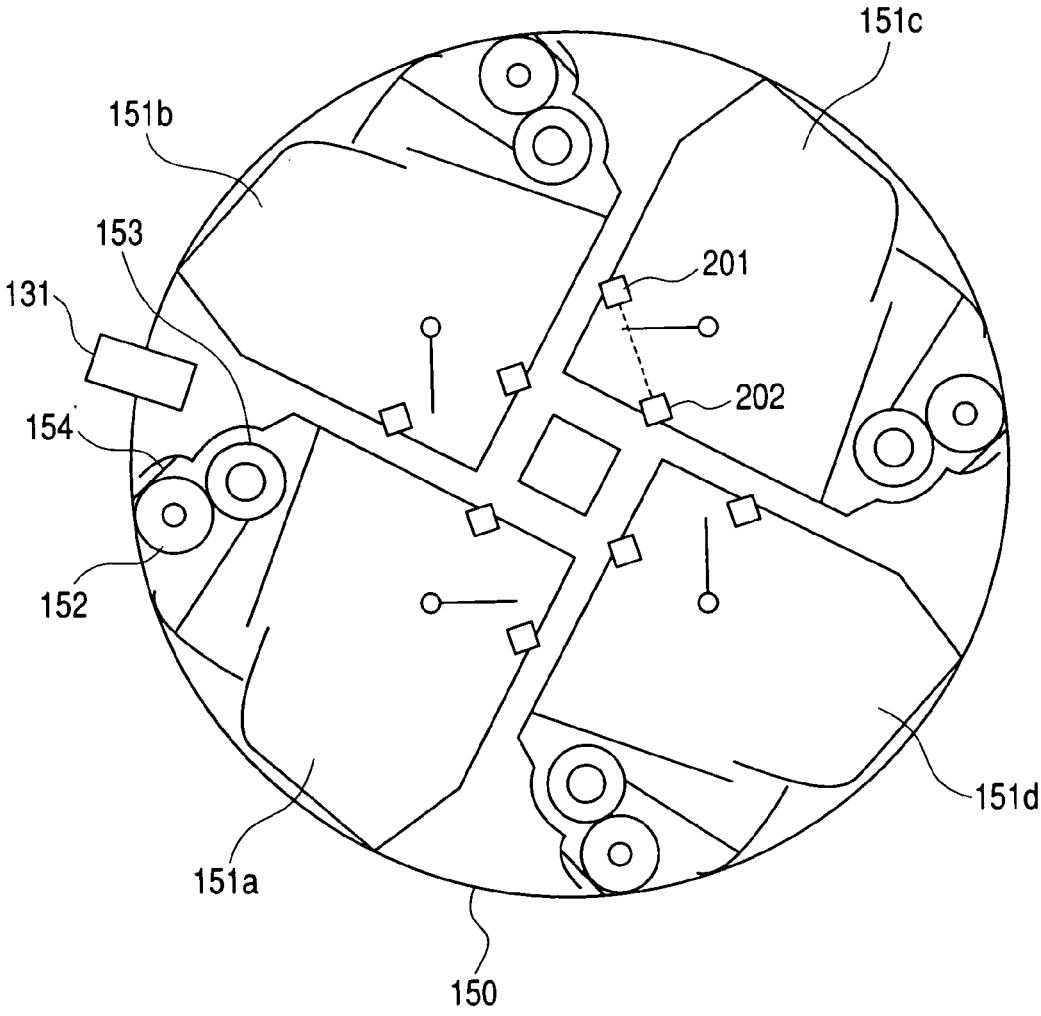
FIG. 3 is a schematic sectional view showing a schematic structure of a developing apparatus holding member in a first embodiment and a third embodiment.

FIG. 3 shows the developer holding member of the image forming apparatus used in this embodiment.

As shown in FIG. 1, in the image forming apparatus of this embodiment, the respective developing apparatuses 151*a* to 151*d* are provided with light guides 207 and 208 consisting of transparent resin or glass. A developer containing part 206 is arranged between these light guides 207 and 208, and a developer 205 is filled in the developer containing part 206. In addition, transparent windows 203 and 204 for transmitting light to the developer containing part 206 are provided in association with the light guides 207 and 208. In detecting a residual amount of developer with first detection means, that is, optical detection means, the CPU 241 causes an LED 221 to emit light.

The light emitted from the LED 221 is caused to be incident in the transparent window 203 via the light guide 207, and the light transmitted through the developer containing part 206 is caused to be incident in the light guide 208 via the transparent window 204. A signal level corresponding to light-emission intensity of the transmitted light is returned to the CPU 241 by an optical sensor 222.

Here, the optical residual developer amount detection device will be described in detail. The optical residual developer amount detection device is operated according to the above-described series of techniques and, in order to judge a residual amount of developer, judges an amount of transmission of light. That is, the optical residual developer amount detection device detects a residual amount of developer by monitoring a transmission time of light caused to be incident in the developing apparatus.

Figure 4:
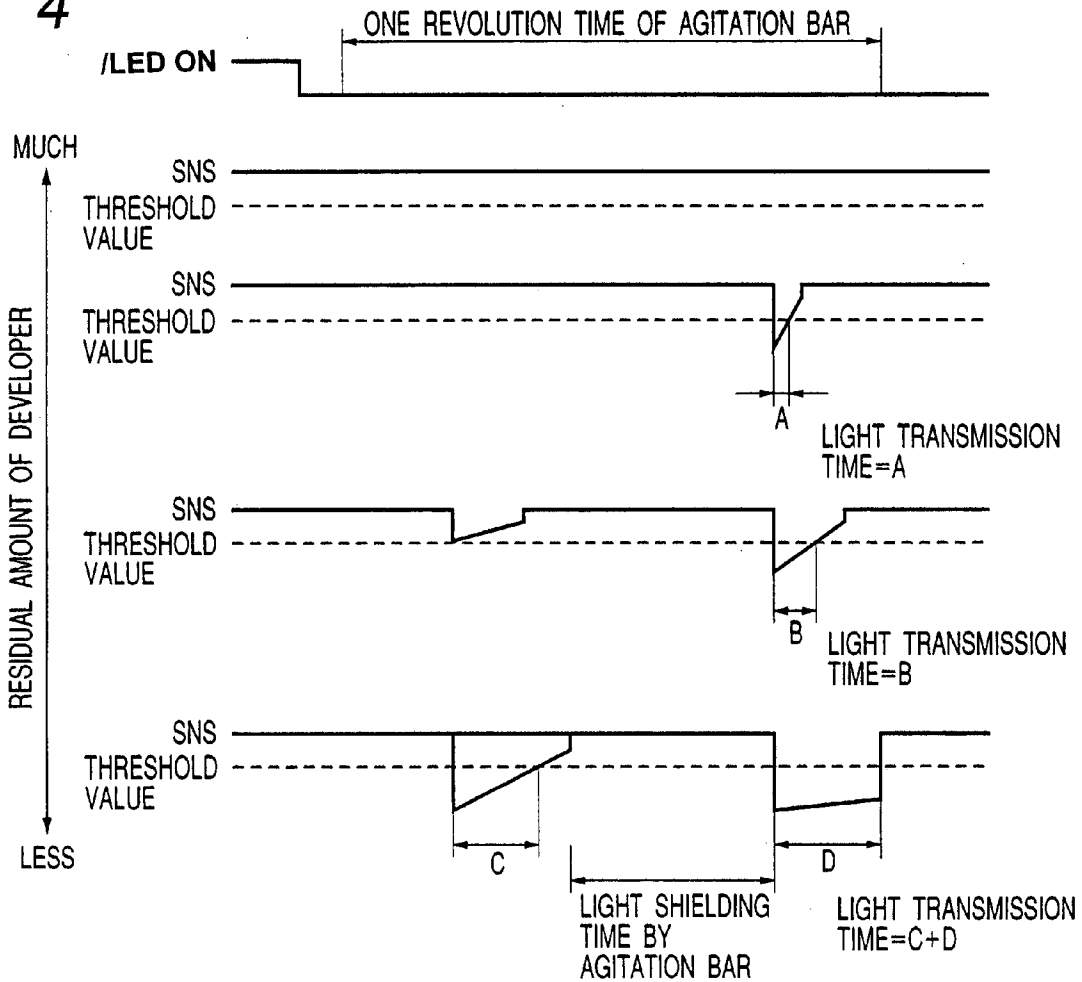
FIG. 4 is a diagram showing an optical detection waveform in the first embodiment and the third embodiment.

A relation between the detected transmitted light and the time is shown in FIG. 4. In the case in which a residual amount of developer is large, the light from the LED 221 cannot be transmitted through the developing apparatuses 151*a* to 151*d* and interrupted by the developer even if the developer is agitated by an agitation bar 171. As a result, the light does not reach the optical sensor 222. However, when the residual amount of developer decreases, the light from the LED 221 gradually becomes able to be transmitted through the developing apparatuses 151*a* to 151*d* by agitating the agitation bar 171. As a result, the light reaches the optical sensor 222. The residual amount of developer is measured by monitoring a transmission amount (transmission time) of light transmitted through the developing apparatuses 151*a* to 151*d*. The transmission amount (transmission time) of light is judged according to a time in which a pulse-like detection signal SNS is smaller than a desired threshold value.

In FIG. 4, the transmission time of light increases in the manner of A<B<(C+D). Therefore, the residual amount of developer decreases in this order. Moreover, after the detection signal SNS is inputted to an A/D port of the CPU 241 in an image forming apparatus control part 240 shown in FIG. 1, the CPU 241 measures a period of time during which the inputted detection signal is equal to or smaller than a desired threshold value, and stores the data in a RAM 243. Then, the CPU 241 compares the data with a table of residual amount of developer measurement stored in the ROM 242 in advance to calculate the residual amount of developer.

Figure 5:
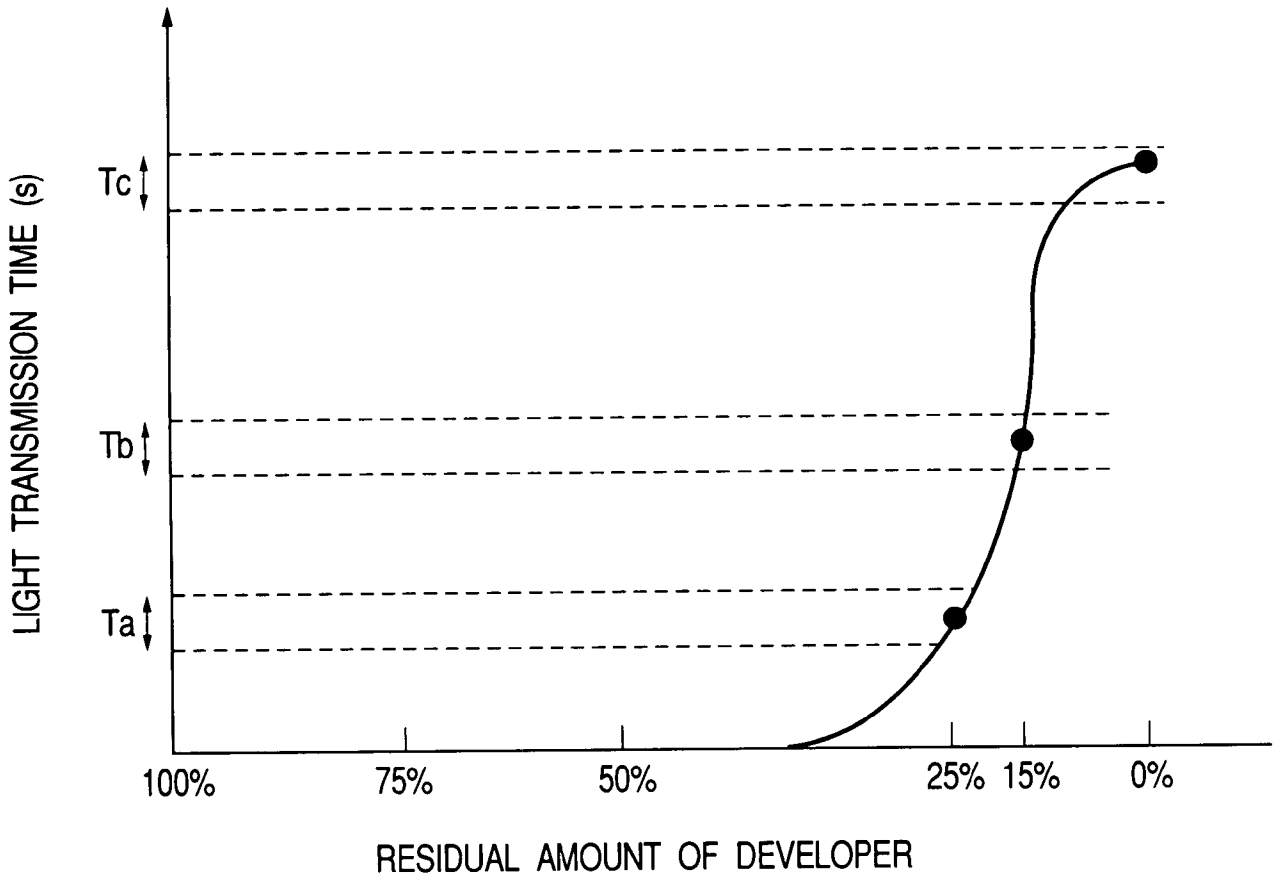
FIG. 5 is a diagram showing a relation between a light transmission time and a residual amount of developer in the first embodiment and the third embodiment.

FIG. 5 shows a relation between a light transmission time and a residual amount of developer. In the case in which the residual amount of developer is 50% or more, since light is hardly transmitted, a change in the residual amount of developer cannot be detected.

On the other hand, in the case in which the residual amount of developer is 25% or less, the detection of residual amount of developer can be performed accurately. If the light transmission time is within ranges of Ta, Tb and Tc, respectively, the residual amount of developer is 25%, 15% and 0%, respectively. Note that the developing apparatuses 151*a* to 151*d* are arranged in the same position as the developing apparatus holding member 150 rotates, and the residual amount of developer is sequentially measured in the same manner.

Figure 6:
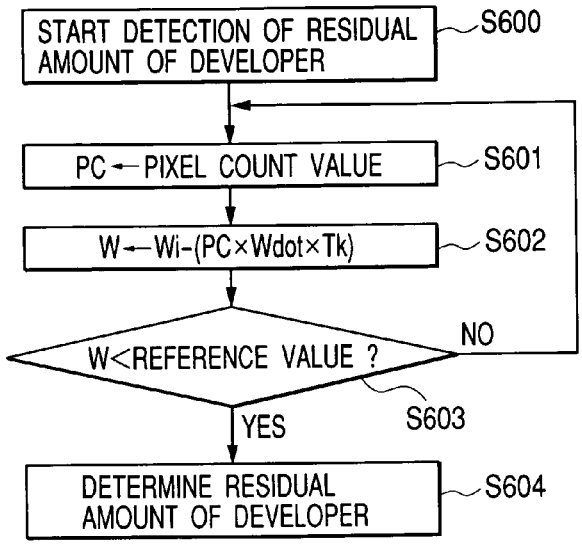
FIG. 6 is a flowchart showing a procedure of a developer detection method according to pixel count in the first embodiment.

Next, a method of presuming a consumption amount of developer at the time of image formation will be described with reference to FIG. 6 and FIG. 7.

Since a consumption amount of developer increases in proportion to the number of pixel counts, a residual amount of developer decreases to the contrary. Thus, since a fixed equation can be applied to the calculation of the consumption amount of developer and the calculation of the residual amount of developer, an equation shown below is applied for presuming the consumption amount of developer.

$$W = Wi - (PC \times Wdot \times Tk) \quad (1)$$

where, PC is a pixel count value, W is a residual amount of developer, Wi is an initial developer filled amount, Wdot is a consumption amount of developer per one pixel, and Tk is transfer efficiency.

The consumption amount of developer is presumed from a value of the above equation, and detection of residual amount of developer is performed according to the estimated consumption amount.

When image formation is started, the detection of residual amount of developer is started (S600). When the detection of residual amount of developer is started, the CPU 241 in the image forming apparatus starts counting of the number of pixels according to image information to be sent (S601). The CPU 241 calculates a residual amount of developer using the above-described expression (1) based upon the count value calculated in the above-described pixel count (S602), and compares the calculated residual amount of developer with a desired reference value (S603). Then, the CPU 241 determines a residual amount of developer level (S604).

Figure 7:
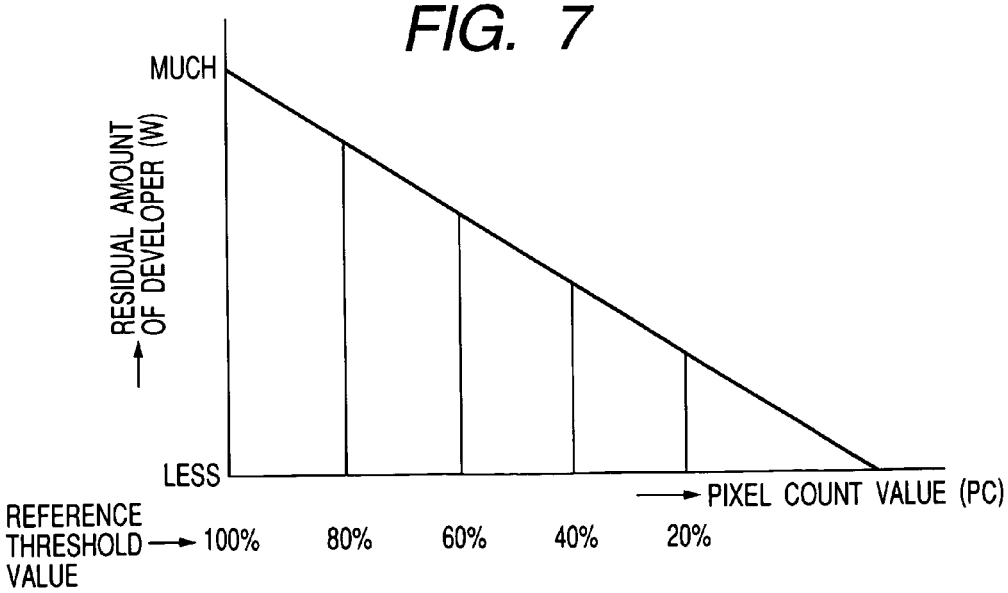
FIG. 7 is a diagram showing a relation between the pixel count and the residual amount of developer in the first embodiment.

FIG. 7 shows a relation between a pixel count value and the residual amount of developer W.

The horizontal axis represents a pixel count value PC. The residual amount of developer W decreases linearly as the pixel count value PC increases. When the residual amount of developer approaches a desired threshold value, an indication of the residual amount of developer is changed.

However, in a result of detection by the detection device for presuming the consumption amount of developer, the linear inclination shown in FIG. 7 is not always the same due to a change in transfer efficiency $T_k$ or a consumption amount of developer $W_{dot}$ under each environment in the case in which image formation is performed. Thus, it is possible that, in the latter half of the linear diagram of FIG. 7, the residual amount of consumption does not coincide with an actual consumption amount.

Figure 16:
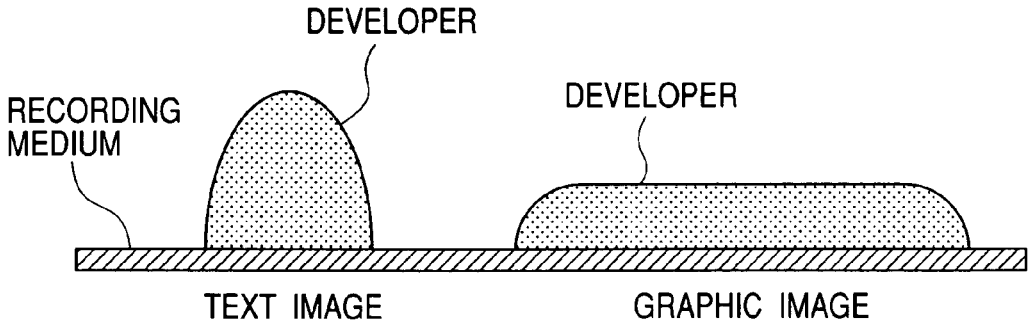
FIG. 16 is a diagram showing an adhesion state of a developer in a text pattern and a graphic pattern.
Figure 17:
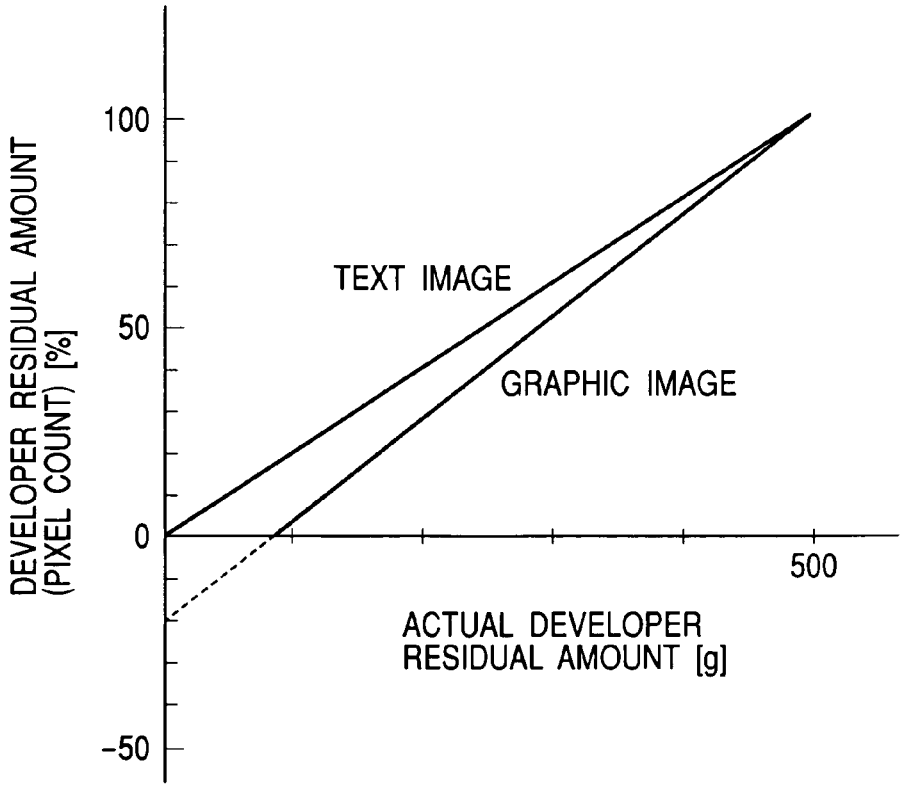
FIG. 17 is a diagram showing how an amount of developer decreases in the case in which ten thousand sheets are printed only in the text pattern and only in the graphic pattern.

For example, the consumption amount of developer differs depending upon whether an image is a graphic pattern (solid image) or a text pattern. Due to the difference of the consumption amount of developer according to the patterns, a calculation error increases in the latter half of a life of a process cartridge. As a schematic view of a consumption amount of toner, FIG. 16 shows an adhesion state of the developer in the text pattern and the graphic pattern. FIG. 16 indicates that the text pattern has more consumption amount of developer (toner) per one dot. FIG. 17 shows how a developer decreases in the case in which ten thousand sheets are printed only in the text pattern and only in the graphic pattern. From this figure, for example, it is seen that a calculation error in a pattern of the pixel count system is about ±10% in the life often thousand sheets of a process cartridge filled with a toner of 500 g. That is, in a process cartridge containing more amount of developer, in particular, in the case in which many images of the graphic pattern are printed, even if a total value of the pixel count is large, an actual consumption amount of toner may be small. Thus, it is difficult to sequentially and accurately detect the residual amount of developer only with the pixel count system.

Therefore, the above-described two detection devices have advantages and disadvantages with respect to the detection of residual amount of developer, respectively. However, the CPU 241 of the image forming apparatus control part 240 determines a residual amount of developer based upon a result of the residual amount of developer detected by the respective detection device, and stores information on the residual amount of developer in the ROM 210 provided in the developing apparatuses 151*a* to 151*d* sequentially or at desired timing.

Figures 8A, 8B:
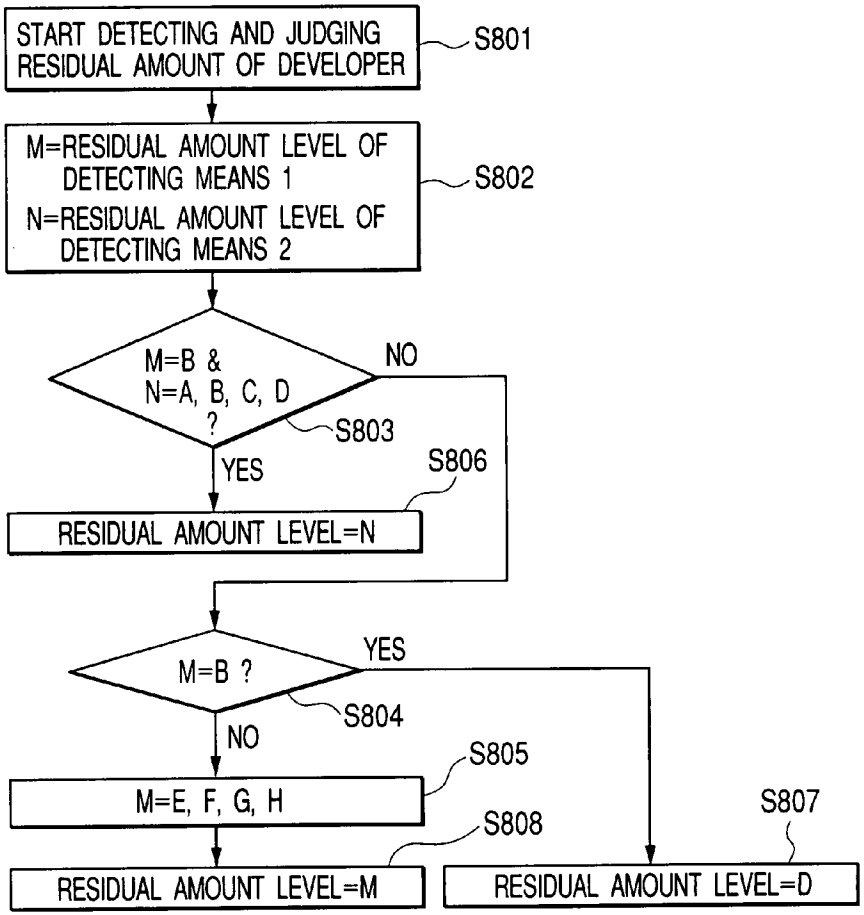
FIG. 8A is a diagram showing a residual amount level according to a result of detection in detection and judgment of residual amount of developer in the first embodiment.
FIG. 8B is a flowchart showing a procedure for residual amount detection and judgment in the detection and judgment of residual amount of developer in the first embodiment.

FIG. 8A and FIG. 8B are diagrams showing detection and judgment of residual amount of developer and show an example of indication of a residual amount of developer and an example of selection of information to be stored.

FIG. 8A is a table showing a residual amount level of the residual amount of developer detected by the respective detection means. In the table, percentage representation indicates a residual amount of developer. FIG. 8B is a flowchart showing a procedure for judging detection of residual amount of developer.

The CPU 241 in the image forming apparatus control part 240 performs judgment of detection of residual amount of developer based upon the information detected by the above-described two detection methods (S801). A result of detection is substituted in a comparison value M, that is, a residual amount level from the optical detection device, and a comparison value N, that is, a residual amount level from the detection device presuming a consumption amount of developer (S802). If M is equal to B and N is equal to any one of A, B, C and D in step 803 (S803), the CPU 241 adopts N as the remaining amount level (S806). If N is equal to any one of E, F, G and H, the CPU 241 judges whether or not M is equal to B in step 804 (S804). If M is equal to B, the CPU 241 adopts D as the residual amount level of developer (S807). If the detection level of the optical detection device is B in step 804 (S804), that is, if the residual amount of developer is larger than a specified residual amount as a result of optical detection, a sequence shifts. In a detection result of a presumption detection device of the consumption amount of developer, due to a change in the transfer efficiency Tk or the consumption amount of developer Wdot under each environment, as described above, in particular, in the case in which many images of the graphic pattern are printed, since an error occurs between a pixel count value and an actual consumption amount of toner, the residual amount level of developer is continued to be in the area of the predetermined level D.

If M is not equal to B in step 804 (S804), M is equal to any one of E, F, G and H in step 805 (S805), and M is adopted as the residual amount level of developer (S808).

Thereafter, as a result of detection of the above-described two detection devices, a judged consumption amount level is stored in the ROM 210 serving as a nonvolatile memory in the developing apparatuses 151*a* to 151*d* as information on the adopted residual amount level of developer. Thus, even if a developing apparatus is replaced at any time, since a residual amount of developer of the developing apparatus is stored accurately according to the information of the ROM 210 in the developing apparatuses 151*a* to 151*d*, it becomes possible to cope with the replacement in any way.

In addition, in this embodiment, a residual amount level is indicated by alphabets. However, actually, the residual amount level is notified to a user with residual amount indication (percentage) corresponding to each alphabet.

As described above, according to this embodiment, since the two detection devices, namely, the optical residual developer amount detection device and the consumption amount of developer presumption device according to pixel count are provided, a result of detection of the consumption amount of toner presumption method according to pixel count is adopted when the residual amount of developer is large, and a result of detection by the optical residual developer amount detection device is adopted when the residual amount of developer is small. Consequently, the residual amount of developer can be detected linearly and sequentially from 100% to 0%, and it becomes possible to indicate an accurate residual amount of developer even at the time when an amount of developer is small. Therefore, it becomes possible to improve usability with respect to replacement or the like of a developing apparatus, which is a replacement part, as in the image forming apparatus used in this embodiment.

Note that, although the residual amount level of developer is indicated in eight stages in this embodiment, the present invention is not limited to this and the residual amount level of developer may be indicated in stages other than eight stages.

SECOND EMBODIMENT

Next, a second embodiment of the present invention will be described with reference to FIG. 9A and FIG. 9B. Note that, since a schematic structure of an image forming apparatus in accordance with this embodiment is the same as that of the image forming apparatus described in the first embodiment, the description of FIG. 2 will be omitted. In addition, since the two detection methods of a residual amount of developer is the same as those in the first embodiment, the description of the detection methods will be omitted.

Figures 9A, 9B:
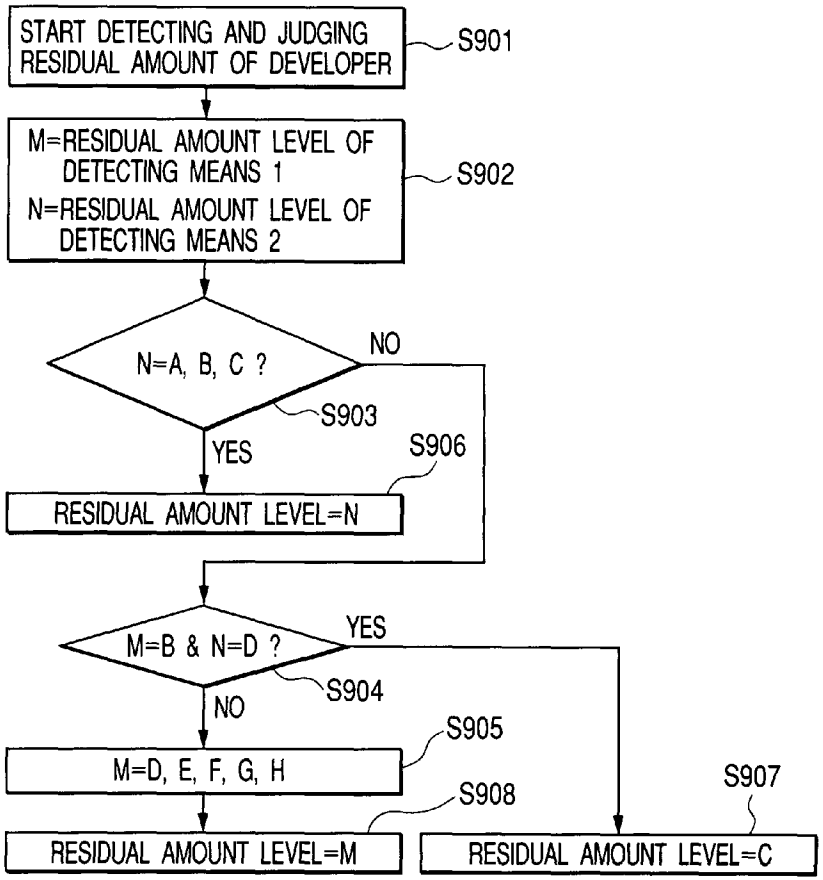
FIG. 9A is a diagram showing a residual amount level according to a result of detection in detection and judgment of residual amount of developer in a second embodiment.
FIG. 9B is a flowchart showing a procedure for residual amount detection and judgment in the detection and judgment of residual amount of developer in the second embodiment.

FIG. 9A and FIG. 9B show an example of indication of a residual amount of developer and an example of selection of information to be stored.

FIG. 9A is a table showing a residual amount level of the residual amount of developer detected by the respective detection devices. In the table, percentage representation indicates a residual amount of developer. FIG. 9B is a flowchart showing a procedure for judging detection of residual amount of developer. The CPU 241 in the image forming apparatus control part 240 performs judgment of detection of residual amount of developer based upon the information detected by the above-described two detection means (S901). In step 902 (S902), a result of detection is substituted in a comparison value M, that is, a residual amount level from the optical detection device, and a comparison value N, that is, a residual amount level from the detection device presuming a consumption amount of developer. If N is equal to any one of A, B and C in step 903 (S903), the CPU 241 adopts N as the remaining amount level (S906). If N is equal to D, the CPU 241 judges whether or not M is equal to B in step 904 (S904). If M is equal to B, the CPU 241 adopts C as the residual amount level of developer (S907).

If the detection level of the optical detection device is B in step 904 (S904), that is, if the residual amount of developer is larger than a specified residual amount as a result of optical detection, a sequence shifts. In a detection result of a presumption detection device of the consumption amount of developer, due to a change in the transfer efficiency Tk or the consumption amount of developer Wdot under each environment, as described above, in particular, in the case in which many images of the graphic pattern are printed, an error occurs between a pixel count value and an actual consumption amount of toner. Therefore, the residual amount level of developer is continued to be in the area of the predetermined level D.

If M is not equal to B and N is not equal to D in step 904 (S904), M is equal to D in step 905 (S905), and M is adopted as the residual amount level of developer in step 908 (S908).

Thereafter, as a result of detection of the above-described two detection devices, a judged consumption amount level is stored in the ROM 210 serving as a nonvolatile memory in the developing apparatuses 15*a* to 15*d* as information on the adopted residual amount level of developer. Thus, even if a developing apparatus is replaced at any time, since a residual amount of developer of the developing apparatus is stored accurately according to the information of the ROM 210 in the developing apparatuses 15*a* to 15*d*, it becomes possible to cope with the replacement in any way.

Note that data of the optical developer residual amount detection means is fixed to B in the range of the residual amount levels A to C because, unlike the first embodiment in which the residual amount of developer is measured since an initial stage, measurement by the optical residual developer amount detection device is not performed in the range of A to C. The optical residual developer amount detection device does not start measurement until the residual amount level has reached D in the detection device of the consumption amount of developer presumption method according to pixel count. In addition, when the residual amount level has reached D in the optical residual developer amount detection device, the pixel count of the detection device of the consumption amount of developer presumption method according to pixel count is stopped.

By selectively performing the developer residual amount detection as described above, load on the CPU 241 can be reduced.

In addition, in this embodiment, a residual amount level is indicated by alphabet characters. However, actually, the residual amount level is notified to a user with residual amount indication (percentage) corresponding to each alphabet character.

As described above, according to this embodiment, since the two detection devices, namely, the optical residual developer amount detection device and the consumption amount of toner presumption device according to pixel count are provided, the detection of the residual amount of developer is selectively performed according to a residual amount of developer in that the detection of the consumption amount of toner presumption method according to pixel count is performed when the residual amount of developer is large, and the detection by the optical residual developer amount detection device is performed when the residual amount of developer is small. Consequently, the residual amount of developer can be detected linearly and sequentially from 100% to 0%, and it becomes possible to indicate an accurate residual amount of developer even at the time when an amount of developer is small. Therefore, it becomes possible to improve usability with respect to replacement or the like of a developing apparatus, which is a replacement part, as in the image forming apparatus used in this embodiment. Note that, although the residual amount level of developer is indicated in eight stages in this embodiment, the present invention is not limited to this and the residual amount level of developer may be indicated in stages other than eight stages.

It is needless to mention that the same effect can be obtained concerning an image forming apparatus to which this embodiment can be applied in condition setting other than the combination of embodiments described above.

In addition, it is needless to mention that the same effect can be obtained concerning an image forming apparatus to which this embodiment can be applied in condition setting other than that used in the second embodiment.

THIRD EMBODIMENT

A third embodiment is an embodiment in the case in which utilized amount detection of a developer carrying member of a developing apparatus is used instead of the consumption amount of developer presumption of the pixel count method in the above-described first embodiment and second embodiment, and the two detection devices, namely, the optical residual developer amount detection device and the utilized amount detection device for the developer carrying member, are combined to function. Since the optical residual developer amount detection device has a similar structure, the description of the repeated parts will be omitted depending upon how the part is modified in the context.

In this third embodiment, both of the optical detection method of residual amount of developer and an apparatus which, when the CPU 241 drives a developer carrying member (developing sleeve roller), detects a utilized amount (rotation time) of the developer carrying member are used, whereby a utilized amount of a developing apparatus can be detected sequentially. Note that, in FIG. 1, one of the developing apparatuses 151*a* to 151*d* in FIG. 2 is shown for convenience's sake.

Reference numeral 210 in FIG. 1 denotes a memory tag which is constituted by a nonvolatile memory which stores information on a residual amount of developer detected by the residual developer amount detection device, information on rotation of a developing sleeve roller, and the like, and a communication control part which controls data communication with the CPU 241 and reads information from and writing information in the memory.

Figure 14:
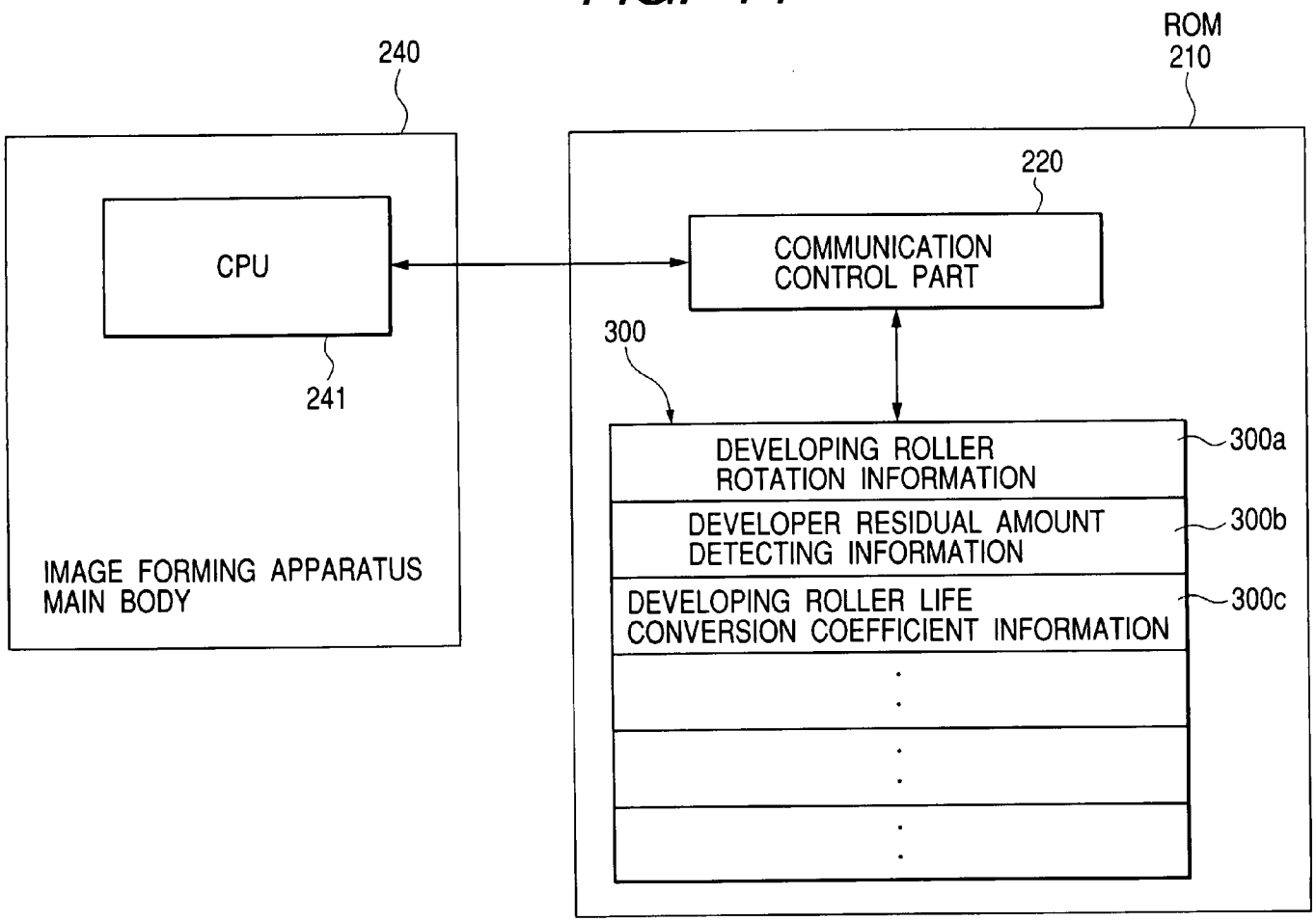
FIG. 14 is a block diagram showing an example of structures of an image forming apparatus control part and a ROM 210 in accordance with the present invention.
Figure 15:
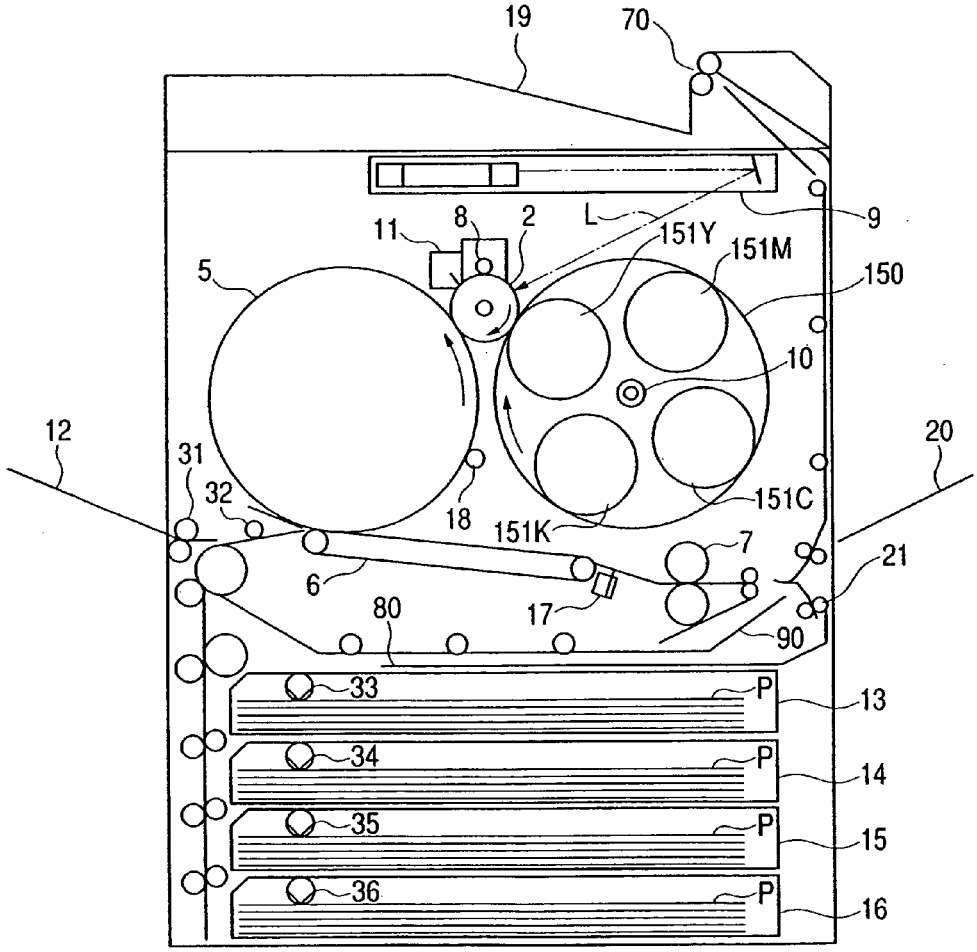
FIG. 15 PRIOR ART
FIG. 15 is a schematic sectional view showing a schematic structure of an image forming apparatus in a conventional example.

In a memory 300 in the memory tag 210, as shown in FIG. 14, there are provided an area 300*a* for storing developing roller rotation information on a rotation time of a developing sleeve roller, an area 300*b* which stores developer residual amount detection information on a residual amount of developer detected by the developer residual amount detection means, and an area 300*c* which stores developing roller life conversion coefficient information on a coefficient for converting a rotation time of a developing sleeve roller described later. Besides, the memory 300 has an area for storing various kinds of utilized amount information on members used in the image forming apparatus.

Next, a method of presuming a rotation time of the developing sleeve roller at the time of image formation will be described with reference to FIG. 10 and FIG. 11.

Figure 10:
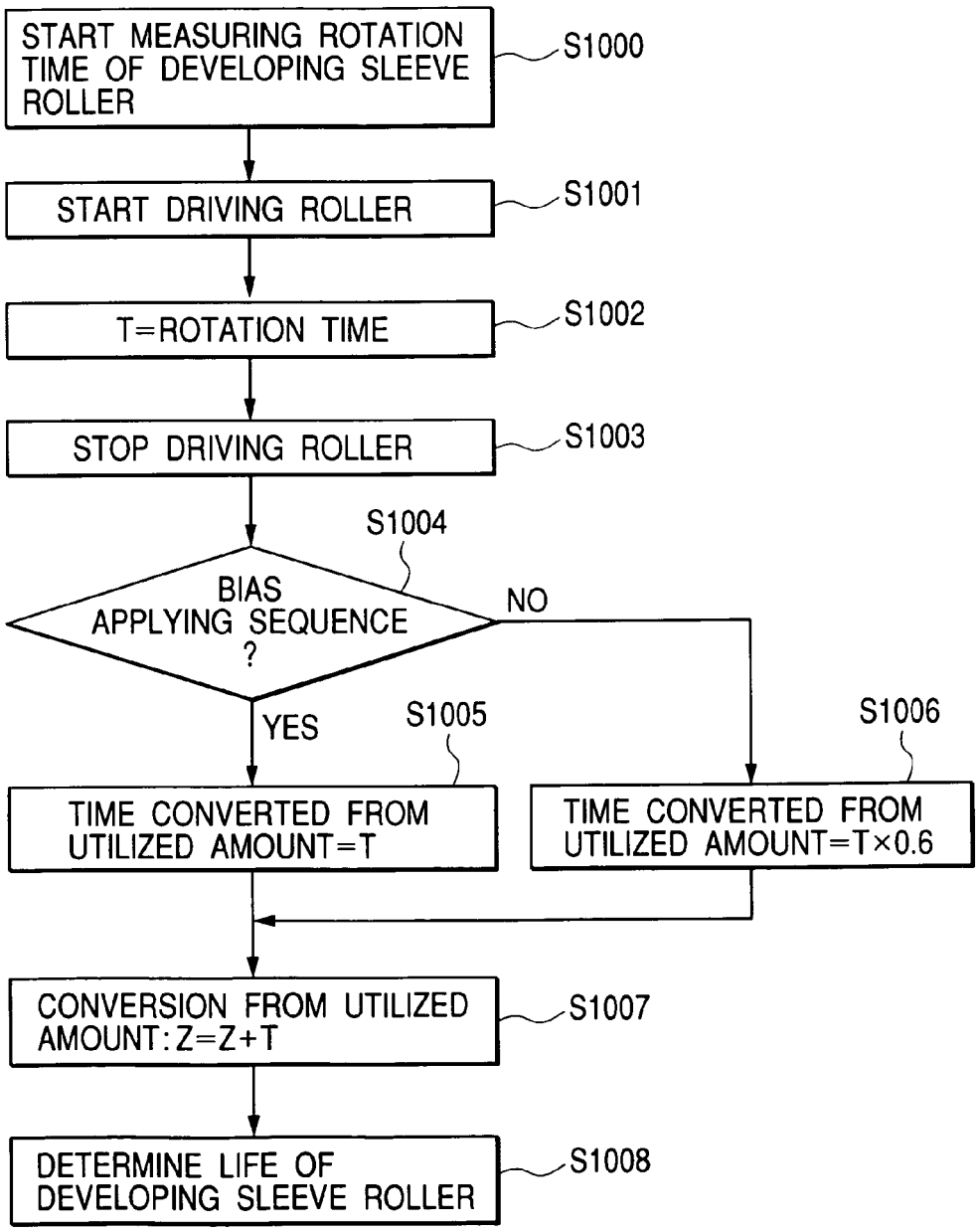
FIG. 10 is a flowchart showing an example of a method of calculating a life of a member in a developer device in the third embodiment.

FIG. 10 is a flowchart showing an example of a method of utilized amount calculation of a developer carrying member in the third embodiment, which shows a series of procedures until a utilized amount of the developer carrying member is detected in presuming a rotation time of the developing sleeve roller 152.

The developing sleeve roller 152 in the developing apparatus is controlled to be rotated by the CPU (241 in FIG. 1) in the image forming apparatus, and a rotation time thereof can be managed by the CPU. First, rotation time measurement of the developing sleeve roller 152 is started when a rotation command is issued by the CPU (S1000). The rotation command is issued at the time of image formation, agitation of the developer in the developing apparatus, or the like. When the rotation command is issued (S1000), roller drive is started (S1001) A rotation time T during this roller drive is measured with the number of rotations presumed in step 1002 (S1002) as a reference. In a short time, when a rotation stop command is issued by the CPU, the developing sleeve roller stops driving (S1003). Thereafter, the CPU judges whether bias application control or bias non-application control was performed when the rotation command of the developing sleeve roller was issued this time (S1004) and calculates a life converted time (S1005, S1006). The rotation time T is multiplied by 0.6 at the time when bias is not applied in step 1006 (S1006). This is because, since deterioration of the developer and abrasion of the developing sleeve roller at the time when bias is not applied is lower than those at the time when bias is applied by approximately 40%, 0.6 is used as a coefficient of time converted from utilized amount with respect to the rotation time of the developing sleeve roller. However, this coefficient is not fixed at 0.6 of this embodiment but varies depending upon a material of the developing roller, a nip pressure, a particle diameter of the developer, or the like. Thus, naturally, a coefficient other than the example indicated in the present invention may be used.

The rotation drive time converted in step S1005 and step S1006 is added up with the cumulative total up to that point in step 1007 (S1007). A utilized amount of the developer carrying member is determined in step 1008 (S1008) based upon the added-up rotation drive time.

Figure 11:
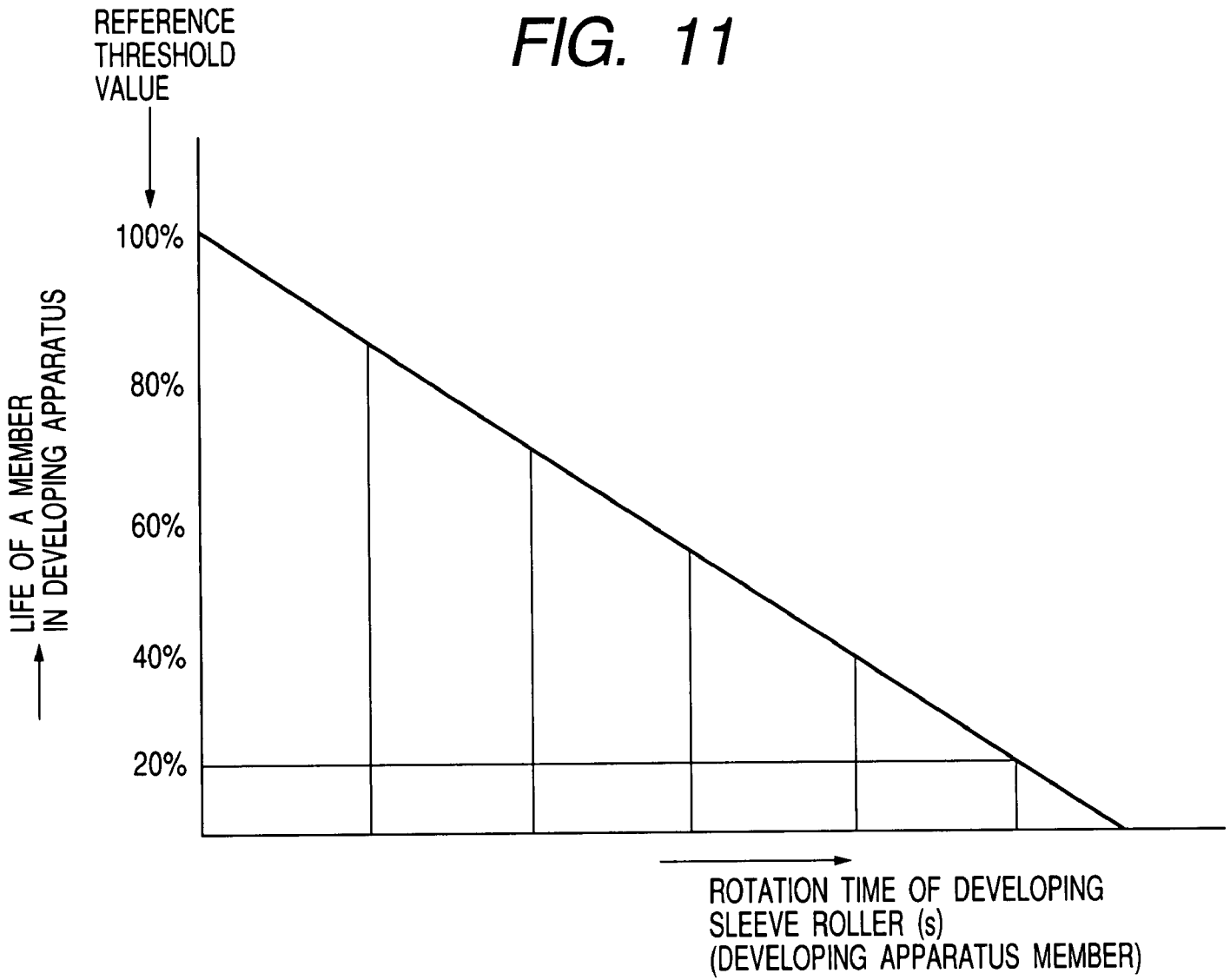
FIG. 11 is a diagram showing a relation between a rotation time of a developing sleeve roller serving as the member of the developing apparatus and the life in the third embodiment.

Next, FIG. 11 shows a relation between a life of the developing sleeve roller serving as the developer carrying member and the rotation time.

Assuming that a residual life of the developer carrying member in the case in which the developing sleeve roller is not rotated in an initial state is 100%, the life decreases in accordance with the rotation time of the developing sleeve roller as shown in FIG. 11. In this embodiment, this parameter is considered for judgment of a utilized amount level of the developing apparatus.

A straight line illustrated at a position of 20% in the latter half of a linear diagram of FIG. 11 indicates a point when a first alarm is designated with respect to the life of the developer carrying member in the present invention.

Therefore, the CPU 241 of the image forming apparatus control part 240 determines utilized amount level of the developing apparatus based upon results of residual amount detection of the developer and utilized amount detection of the developer carrying member carried out by the respective detection means, and stores information on the utilized amount level of the developing apparatus in the memory tag 210 provided in the developing apparatuses 15*a* to 15*d* sequentially or at desired timing.

Figures 12A, 12B:
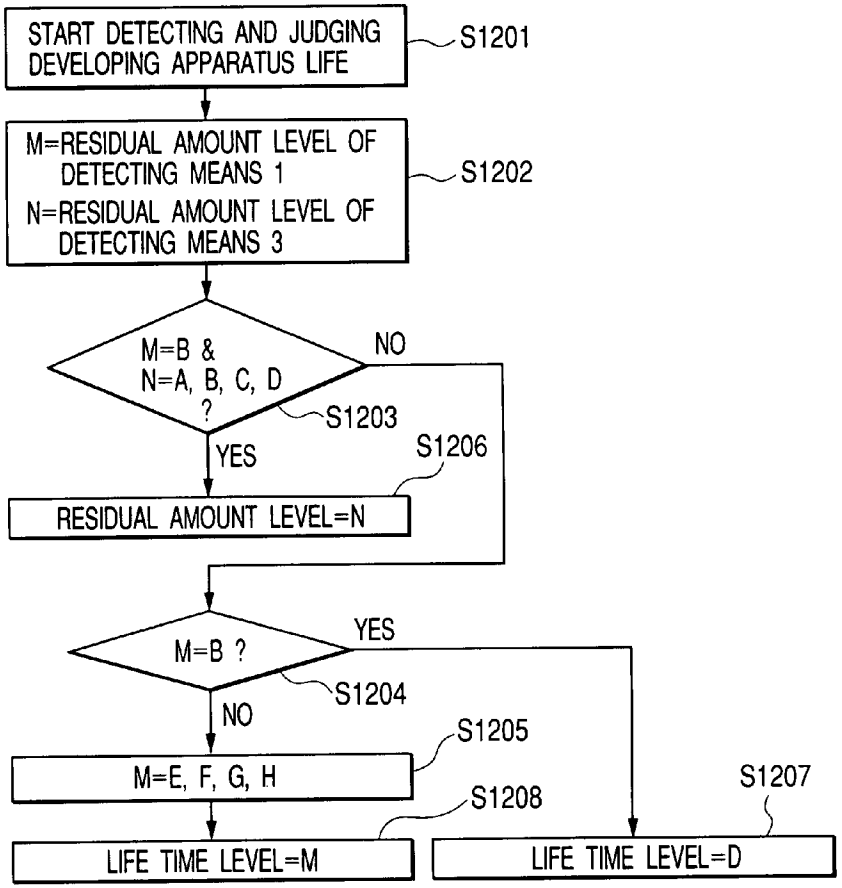
FIG. 12A is a diagram showing a life level according to a result of detection in developing apparatus life detection and judgment in the third embodiment.
FIG. 12B is a flowchart showing a procedure for life detection and judgment.

FIG. 12A and FIG. 12B are diagrams showing judgment of a utilized amount level of a developing apparatus and show an example of indication of the utilized amount level of the developing apparatus and an example of selection of information to be stored.

FIG. 12A is a table showing a residual amount level of a residual amount of developer and a utilized amount at the number of rotations of the developing sleeve roller detected by the respective detection devices. A percentage indication in the table indicates the residual amount of the developer and the utilized amount of the developer carrying member (developing sleeve roller). FIG. 12B is a flowchart showing a procedure for judging the utilized amount level of the developing apparatus.

The CPU 241 in the image forming apparatus control part 240 judges the utilized amount level of the developing apparatus based upon information detected by the two detection devices described above (S1201). In step 1202 (S1202), a result of detection is substituted in a comparison value M, that is, a residual amount level from the optical detection device, and a comparison value N, that is, a utilized amount level of the utilized amount detection device for the developer carrying member. If M is equal to B and N is equal to any one of A, B, C and D in step 1203 (S1203), the CPU 241 adopts N as the utilized amount level of the developing apparatus (S1206). If N is equal to any one of E, F, G and H, the CPU 241 judges whether or not M is equal to B in step 1204 (S1204). If M is equal to B, the CPU 241 adopts D as the utilized amount level of developing apparatus (S1207).

The sequence shifts to step 1204 (S1204) or the like. That is, the sequence shifts to S1204 in the case in which the developing sleeve roller serving as the developer carrying member has rotated the number of times equal to or more than the number of rotation level despite the fact the residual amount of developer is large when the result of detection of the utilized amount detection device for the developer carrying member shows that a large volume of sheets are printed in a print mode for printing an image of a low printing ratio. In this case, if the utilized amount level of the developing apparatus is judged according to the number of rotations of the developing sleeve roller, the CPU 241 shows a state in which the utilized amount level of the developing apparatus is closed to a life (replacement period) level despite the fact that the developer still remains sufficiently. Thus, the utilized amount level of the developing apparatus is maintained at D. Note that, as an example of the case in which an image of a low printing ratio is printed, this often occurs when an image with only one color point in a text image (e.g., an image such as an underlineation) is mainly printed.

Note that, in the case in which the number of rotations of the developer carrying member (developing sleeve roller) has reached a predetermined level or more in a state in which the residual amount level M of the optical detection device is equal to B, that is, the residual amount of developer is still sufficient, if the utilized amount level of the developing apparatus is maintained at the predetermined level D, since the amount of the developer is larger than the predetermined residual amount, deterioration of the developer is less even if the number of rotations of the sleeve roller is larger to some extent, and problems such as the problem related to a life due to the number of rotations does not occur.

The deterioration of the sleeve roller is caused by increasing friction between the sleeve roller and a developing blade, which is in contact with the sleeve, due to adhesion of an externally-added agent contained in the toner on the sleeve roller. Even if the sleeve roller is rotated in a state in which the amount of the developer is larger than the predetermined residual amount, the externally-added agent hardly adheres to the sleeve roller. When the developer is used and the amount of the developer has become smaller than the predetermined residual amount, the externally added agent adheres to the sleeve roller in a large quantity. As a result, friction with the developing blade increases to deteriorate the sleeve roller.

If M is not equal to B in step 1204 (S1204), M is equal to any one of E, F, G and H in step 1205 (S1205), and M is adopted as the utilized amount level of developer in step 1208 (S1208).

Thereafter, as information on the adopted utilized amount level of the developing apparatus, developing sleeve roller rotation information, developer residual amount detecting information, and developing roller life conversion coefficient information (see FIG. 14) are stored in a memory in the memory tag 210 in the developing apparatuses 151*a* to 151*d*.

Thus, even if a developing apparatus is replaced at any time, since the utilized amount level of the developing apparatus is stored accurately according to the information of the memory in the memory tag 210 in the developing apparatuses 151*a* to 151*d*, it becomes possible to cope with the replacement in any way.

For example, even in the case in which the developing apparatus is removed and then mounted again, since the above-described information is stored in the memory in the memory tag 210 of the developing apparatus, it becomes possible to grasp a state of the developing apparatus accurately without a wrong detection.

In addition, in this embodiment, a life level is indicated by alphabets. However, actually, the life level is notified to a user with a life indication (percentage) corresponding to each alphabet character.

As described above, according to this embodiment, since both the two detection devices, namely, the optical residual developer amount detection device and the utilized amount detection device for the developer carrying member according to detection of developing sleeve roller rotation time are used, a result of detection of the utilized amount detection device for the developer carrying member is adopted when the residual amount of developer is large, and a result of detection by the optical residual developer amount detection device is adopted when the residual amount of developer is small. Consequently, the utilized amount of the developing apparatus can be detected linearly and sequentially from 100% to 0%, and it becomes possible to indicate a utilized amount level of the developing apparatus taking into account an accurate residual amount even at the time when an amount of developer is small. Therefore, it becomes possible to improve usability with respect to replacement or the like of a developing apparatus, which is a replacement part, as in the image forming apparatus used in this embodiment.

Note that, both the above-described two detection devices are used so as to prevent a life of a developing apparatus from being exceeded to cause damages for a user such as an defective image or contamination in the apparatus due to problems which occur in the case in which the residual amount of toner is extremely small or problems due to developing sleeve roller rotation exceeding a specified time, whereby accurate detection of the life of the developing apparatus can be performed.

Note that, although the utilized amount level of developing apparatus is indicated in eight stages in this embodiment, the present invention is not limited to this and the utilized amount level of developing apparatus may be indicated in stages other than eight stages.

FOURTH EMBODIMENT

Next, a fourth embodiment of the present invention will be described with reference to FIG. 13A and FIG. 13B. Note that a schematic structure of an image forming apparatus in accordance with this embodiment is the same as the schematic structure of the image forming apparatus described in the first embodiment, the description of FIG. 2 will be omitted. In addition, since the optical residual developer amount detection device and the utilized amount detection device according to rotation time detection of the developer carrying member (developing sleeve roller) are the same as those in the embodiment described above, the description of the devices will be omitted.

Figures 13A, 13B:
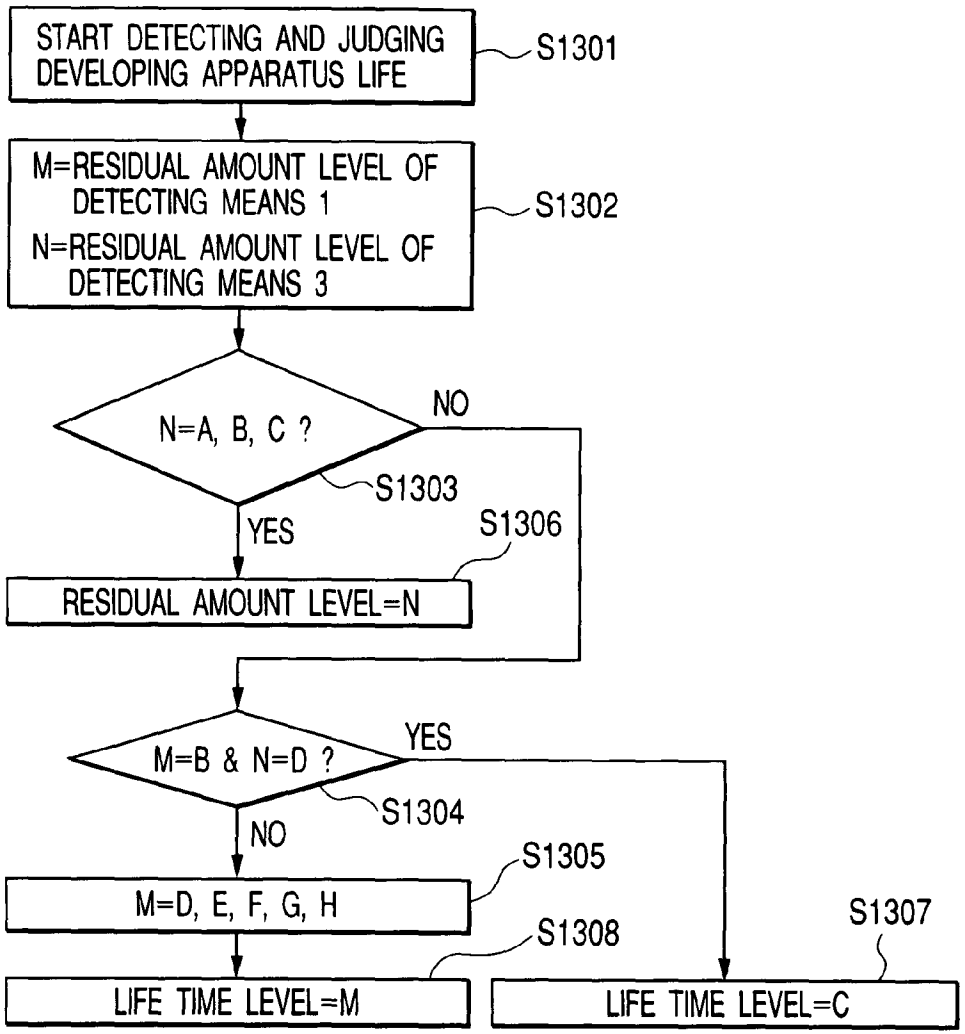
FIG. 13A is a diagram showing a life level according to a result of detection in developing apparatus life detection and judgment in a fourth embodiment.
FIG. 13B is a flowchart showing a procedure for life detection and judgment.

FIG. 13A and FIG. 13B are diagrams showing judgment of a utilized amount of a developing apparatus in the fourth embodiment and show an example of indication of the utilized amount of the developing apparatus and an example of selection of information to be stored.

FIG. 13A is a table showing a residual amount level of developer and a utilized amount level of the developer carrying member which are detected by the respective detection devices. A percentage indication in the table indicates a utilized amount level of the developing apparatus.

FIG. 13B is a flowchart showing a procedure for judging the utilized amount level of the developing apparatus. The CPU 241 in the image forming apparatus control part 240 judges the utilized amount level of the developing apparatus based upon information detected by the two detection devices described above (S1301). In step 1302 (S1302), a result of detection is substituted in a comparison value M, that is, a residual amount level from the optical detection device, and a comparison value N, that is, a utilized amount level of the utilized amount detection device for the developer carrying member. If N is equal to any one of A, B and C in step 1303 (S1303), the CPU 241 adopts N as the utilized amount level of the developing apparatus (S1306). If N is equal to D, the CPU 241 judges whether or not M is equal to B in step 1304 (S1304). If M is equal to B, the CPU 241 adopts C as the utilized amount level of developing apparatus (S1307).

The sequence shifts to step 1304 (S1304) or the like. That is, the sequence shifts to S1304 in the case in which the developing sleeve roller rotated the number of times equal to or more than the number of rotation level despite the fact the residual amount of developer is large when the result of detection of the utilized amount detection device for the developer carrying member (developing sleeve roller) shows that a large volume of sheets are printed in a print mode for printing an image of a low printing ratio. In this case, if the utilized amount level of the developing apparatus is judged according to the number of rotations of the developing sleeve roller, the CPU 241 shows a state in which the utilized amount level of the developing apparatus is closed to a life (replacement period) level despite the fact that the developer still remains sufficiently. Thus, the life (utilized amount) level of the developing apparatus is maintained at C. Note that, as an example of the case in which an image of a low printing ratio is printed, this often occurs when an image with only one color point in a text image (e.g., an image such as an underlineation) is mainly printed.

If M is not equal to B and N is not equal to D in step 1304 (S1304), the residual amount level M is equal to D in step 1305 (S1305), and M is adopted as the life level of the developing apparatus in step 1308 (S1308).

Note that, in the case in which the number of rotations of the developer carrying member (developing sleeve roller) has reached a predetermined level or more in a state in which the residual amount level M of the optical detection device is equal to B, that is, the residual amount of developer is still sufficient, if the utilized amount level of the developing apparatus is maintained at the predetermined level C, since the amount of the developer is larger than the predetermined residual amount, deterioration of the developer is less even if the number of rotations of the sleeve roller is larger to some extent, and problems, such as the problem related to a life due to the number of rotations, do not occur.

The deterioration of the sleeve roller is caused by increasing friction between the sleeve roller and a developing blade, which is in contact with the sleeve, due to adhesion of an externally-added agent contained in the toner on the sleeve roller. Even if the sleeve roller is rotated in a state in which the amount of the developer is larger than the predetermined residual amount, the externally-added agent hardly adheres to the sleeve roller. When the developer is used and the amount of the developer has become smaller than the predetermined residual amount, the externally added agent adheres to the sleeve roller in a large quantity. As a result, friction with the developing blade increases to deteriorate the sleeve roller.

Thereafter, as information on the adopted utilized amount level of the developing apparatus, developing sleeve roller rotation information, developer residual amount detecting information, and developing roller life conversion coefficient information (see FIG. 14) are stored in a memory in the memory tag 210 in the developing apparatuses 151*a* to 151*d*. Thus, even if a developing apparatus is replaced at any time, since information on the utilized amount level of the developing apparatus is stored accurately according to the information of the memory in the memory tag 210 in the developing apparatuses 151*a* to 151*d*, it becomes possible to cope with the replacement in any way.

Note that data of the optical developer residual amount detection means is fixed to B in the range of the residual amount levels A to C because, unlike the third embodiment in which the residual amount of developer is measured since an initial stage, measurement by the optical residual developer amount detection device is not performed in the range of A to C. The optical residual developer amount detection device does not start measurement until the residual amount level has reached D in the utilized amount level detection device of developer carrying member. In addition, when the residual amount level has reached D in the optical residual developer amount detection device, the measurement of the number of rotations of the utilized amount level detection device for the developer carrying member is stopped.

By selectively performing the developer residual amount detection and the utilized amount detection for the developer carrying member as described above, load on the CPU 241 can be reduced.

In addition, in this embodiment, a life level is indicated by alphabets. However, actually, the life level is notified to a user with residual amount indication (percentage) corresponding to each alphabet character.

As described above, according to this embodiment, since the two detection devices, namely, the optical residual developer amount detection device and the utilized amount level detection device for the developer carrying member are provided, a result of detection of the utilized amount level detection method for the developer carrying member is adopted when the residual amount of developer is large, and a result of detection by the optical detection method of residual amount of developer is adopted when the residual amount of developer is small to judge the utilized amount level of the developing apparatus. Consequently, the life of the developing apparatus can be detected linearly and sequentially from 100% to 0%, and it becomes possible to indicate an accurate utilized amount level of the developing apparatus even at the time when an amount of developer is small. Therefore, it becomes possible to improve usability with respect to replacement or the like of a developing apparatus, which is a replacement part, as in the image forming apparatus used in this embodiment.

In addition, both the above-described two detection devices are used so as to prevent a life of a developing apparatus from being exceeded to cause damages for a user such as an defective image or contamination in the apparatus due to problems which occur in the case in which the residual amount of toner is extremely small or problems due to developing sleeve roller rotation exceeding a specified time, whereby accurate detection of the utilized amount of the developing apparatus can be performed.

Note that, although the utilized amount level of the developing apparatus is indicated in eight stages in this embodiment, the present invention is not limited to this and the utilized amount level of the developing apparatus may be indicated in stages other than eight stages.

In addition, it is needless to mention that the same effect can be obtained concerning an image forming apparatus to which this embodiment can be applied in condition setting other than that used in combinations of the above-described embodiments.

In addition, it is needless to mention that the same effect can be obtained concerning an image forming apparatus to which this embodiment can be applied in condition setting other than that used in the fourth embodiment.

Moreover, naturally, information to be stored in the memory means provided in the respective developing apparatuses is not limited to the information described above, and respective detection results may be combined to be stored.

According to the first embodiment or the second embodiment of the present invention, the residual amount of developer can be detected linearly and sequentially from 100% to 0%, and it becomes possible to indicate an accurate residual amount of developer even at the time when an amount of developer is small.

In addition, according to the third embodiment or the fourth embodiment of the present invention, the utilized amount level of the developing apparatus can be detected linearly and sequentially from 100% to 0%, and it becomes possible to indicate an accurate utilized amount level of the developing apparatus even at the time when an amount of developer is small.

The present invention is not limited to the above-described embodiments but can include modifications of the identical technical thought.

What is claimed is:

1. An image forming apparatus to which a developing apparatus for developing a latent image on an image bearing member corresponding to image information is detachably attachable, comprising:

a first detection device for presuming a first remaining amount of the developer in said developing apparatus based upon the image information;

a second detection device for detecting a second remaining amount of the developer in said developing apparatus; and a processing unit for determining an indicating level of the remaining amount of the developer in said developing apparatus based upon results of detections of said first detection device and said second detection device, wherein in a case that the first remaining amount of the developer presumed by said first detection device is equal to or less than an amount defined as a predetermined amount, and the second remaining amount of the developer detected by said second detection device is equal to or more than the predetermined amount, the indicating level determined by said processing unit of the remaining amount of the developer in said developing apparatus is different from both an indicating level according to the first remaining amount of the developer by said first detection device and an indicating level according to the second remaining amount of the developer detected by said second detection device.

2. An image forming apparatus according to claim 1, wherein said second detection device is an optical detection device.

3. An image forming apparatus according to claim 1, wherein said developing apparatus has memory means for storing information relating to a result of detection of said first detection device or a result of detection of said second detection device.

4. An image forming apparatus according to claim 3, wherein said memory means is nonvolatile memory means which is capable of communicating with a main body of said image forming apparatus in a contact state or in a non-contact state.

5. A control method for an image forming apparatus to which a developing apparatus for developing a latent image on an image bearing member corresponding to image information is detachably attachable and which comprises a first detection device for presuming a first remaining amount of developer in the developing apparatus based upon the image information, and a second detection device for detecting a second remaining amount of developer in the developing apparatus, the control method comprising:

a first judging step of judging whether or not a first remaining amount of the developer detected by the first detection device is equal to or less than a predetermined amount; and a second judging step of judging whether or not a second remaining amount of the developer detected by the second detection device is equal to or more than the predetermined amount;

a determining step for determining, in a case that the first remaining amount of the developer judged in said first judging step is equal to or less than the predetermined amount, and the second remaining amount of the developer detected in said second judging step is equal to or more than the predetermined amount an indicating level of the remaining amount of the developer in the developing apparatus so that the indicating level is different from both an indicating level according to the first remaining amount of the developer detected by said first detection device and an indicating level according to the second remaining amount of the developer detected by said second detection device.

6. An image forming apparatus to which a developing apparatus including a developer carrying member for developing a latent image on an image bearing member is detachably attachable, comprising:

a first detection device for detecting a utilized amount of said developer carrying member of the developing apparatus;

a second detection device for detecting a remaining amount of developer in said developing apparatus; and a processing unit for determining an indicating level of a utilized amount of said developing apparatus based upon results of detection of said first detection device and said second detection device, wherein in a case that the utilized amount of said developer carrying member detected by said first detection device is equal to or less than a predetermined amount, and the remaining amount of the developer detected by said second detection device is equal to or more a predetermined level, the indicating level of a utilized amount of said developing apparatus determined by said processing unit is different from both an indicating level of a utilized amount of said developing apparatus according to the utilized amount of said developer carrying member detected by said first detection device and an indicating level of a utilized amount of said developing apparatus according to the remaining amount of the developer detected by said second detection device.

7. An image forming apparatus according to claim 6, wherein said second detection device is an optical detection device.

8. An image forming apparatus according to claim 7, wherein said first detection device detects an operation time of said developer carrying member to judge the utilized amount of said developer carrying member.

9. An image forming apparatus according to claim 6, wherein said developing apparatus includes memory means for storing information relating to a result of detection of said first detection device or a result of detection of said second detection device.

10. An image forming apparatus according to claim 9, wherein said memory means is nonvolatile memory means which is capable of communicating with a main body of said image forming apparatus in a contact state or in a non-contact state.

11. A control method for an image forming apparatus to which a developing apparatus including a developer carrying member for developing a latent image on an image bearing member is detachably attachable and which comprises a first detection device for detecting a utilized amount of the developer carrying member of the developing apparatus and a second detection device for detecting a remaining amount of developer in the developing apparatus, the control method comprising:

a first judging step of judging whether or not a utilized amount of the developer carrying member detected by the first detection device is equal to or less than a predetermined amount;

a second judging step of judging whether or not a remaining amount of the developer detected by the second detection device is equal to or more than a predetermined amount; and a determining step of determining in a case that the utilized amount of the developer carrying member judged in the first device is equal to or less than the predetermined amount, and the remaining amount of the developer judged in said second judging step is equal to or more than the predetermined amount, the indicating level of a utilized amount of the developing apparatus is different from both an indicating level of a utilized amount of the apparatus according to the utilized amount of the developer carrying member detected by the first detection device and an indicating level of a utilized amount of the developing apparatus according to the remaining amount of the developer detected by the second detection device.

* * * * *

UNITED STATES PATENT AND TRADEMARK OFFICE

CERTIFICATE OF CORRECTION

PATENT NO. : 7,095,964 B2
APPLICATION NO. : 10/664888
DATED : August 22, 2006
INVENTOR(S) : Shoichi Koyama et al.

It is certified that error appears in the above-identified patent and that said Letters Patent is hereby corrected as shown below:

COLUMN 3:
Line 23, “more” should read --more than--.
Line 48, “more” should read --more than--.

COLUMN 4:
Line 8, “more” should read --more than--.
Line 10, “determining,” should read --determining--.
Line 15, “level an indicating” should read --level, the indicating--.
Line 42, “judging” should read --judged--.
Line 43, “the first device” should read --the first judging step--.
Line 46, “amount, the” should read --amount, an--.

COLUMN 10:
Line 57, “often” should read --of ten--.

COLUMN 11:
Line 60, “alphabets.” should read --alphabet characters.--.
Line 62, “alphabet.” should read --alphabet character.--.

COLUMN 14:
Line 66, “(S1000)” should read --(S1000).--.

COLUMN 16:
Line 54, “externally added” should read --externally-added--.

COLUMN 17:
Line 14, “alphabets.” should read --alphabet characters.--.
Line 39, “an” should read --a--.

COLUMN 19:
Line 4, “externally added” should read --externally-added--.
Line 39, “alphabets.” should read --alphabet characters.--.
Line 64, “an” should read --a--.

COLUMN 21:
Line 28, “determining,” should read --determining--.
Line 33, “amount, the” should read --amount, an--.
Line 58, “more” should read --more than--.

UNITED STATES PATENT AND TRADEMARK OFFICE

CERTIFICATE OF CORRECTION

PATENT NO. : 7,095,964 B2
APPLICATION NO. : 10/664888
DATED : August 22, 2006
INVENTOR(S) : Shoichi Koyama et al.

It is certified that error appears in the above-identified patent and that said Letters Patent is hereby corrected as shown below:

COLUMN 22:
Line 46, "the first device" should read --said first judging step--.
Line 49, "amount, the" should read --amount, an--.
Line 52, "of the" should read --of the developing--.

Signed and Sealed this

Tenth Day of April, 2007

JON W. DUDAS
*Director of the United States Patent and Trademark Office*